United States Patent [19]

Pratt et al.

[11] Patent Number: 4,671,721

[45] Date of Patent: Jun. 9, 1987

[54] APPARATUS AND METHOD FOR POSITIONING AN OBJECT IN A BUILDING

[76] Inventors: Rodger Pratt, 5436 104th Ave. NE., Kirkland, Wash. 98033; Michael Sparling, 6122 234th St., NE., Woodinville, Wash. 98072

[21] Appl. No.: 588,388

[22] Filed: Mar. 12, 1984

[51] Int. Cl.[4] ..... B66C 1/00

[52] U.S. Cl. ..... 414/10; 187/2; 294/67.1; 294/67.5; 414/785; 414/11; 414/754; 414/590

[58] Field of Search ..... 187/2; 52/745, 747, 52/749; 254/904, 905, 910; 414/10, 11, 12, 589, 590, 680, 684.3, 607, 592, 662, 672, 785, 673, 701, 705, 719, 697, 735, 754, 685, 667, 671; 294/81.3, 81.4, 67.2, 67.21, 67.22, 82.12, 67.5, 81.5, 67.1, 82.15, 671, 67.3, 67.4

[56] References Cited

U.S. PATENT DOCUMENTS

| | | | |
|---|---|---|---|
| 2,652,937 | 9/1953 | Cutler | 294/67.2 |
| 2,668,602 | 2/1954 | Cushman | 414/667 |
| 2,794,336 | 4/1957 | Ballou | 52/745 X |
| 2,843,280 | 7/1958 | Stopps | 414/785 X |
| 3,253,852 | 5/1966 | Wheat | 294/67.1 |
| 3,361,280 | 1/1968 | Traver | 414/11 X |
| 3,409,158 | 11/1968 | Lull | 414/11 X |
| 3,593,672 | 7/1971 | Breen et al. | 414/608 X |
| 3,596,968 | 8/1971 | Holm | 294/81.3 |
| 3,675,961 | 7/1972 | Wheeler | 294/67.1 |
| 3,828,940 | 8/1974 | Cooper | 294/81.4 X |
| 3,881,620 | 5/1975 | Wacker | 414/607 |
| 3,998,488 | 12/1976 | Durgan | 294/67.21 |

FOREIGN PATENT DOCUMENTS

| | | | |
|---|---|---|---|
| 2404025 | 7/1975 | Fed. Rep. of Germany | 52/745 |
| 33245 | 3/1977 | Japan | 414/671 |
| 856356 | 12/1960 | United Kingdom | 52/749 |

*Primary Examiner*—Frank E. Werner
*Attorney, Agent, or Firm*—Thomas W. Secrest

[57] ABSTRACT

This invention is directed to an apparatus for lifting objects. The apparatus is suspended from a cable which is attached to a crane. The apparatus is used in construction such as in the construction of buildings. The apparatus can connect with a precast concrete panel and lift the precast concrete panel to a desired opening in a building under construction. Also, the apparatus can lift building material to a desired opening in a building, to a proper location in a dam under construction, and to a tower under construction such as a high voltage electric line tower, a radio and television tower and the like. The crane can be on top of the article being constructed such as a building or a dam or the crane can be on the ground. The cable is suspended from the crane and attaches to the apparatus so that the position of the apparatus can be varied both horizontally and vertically and also away from the article under construction and toward the article under construction.

20 Claims, 43 Drawing Figures

FIG. 19
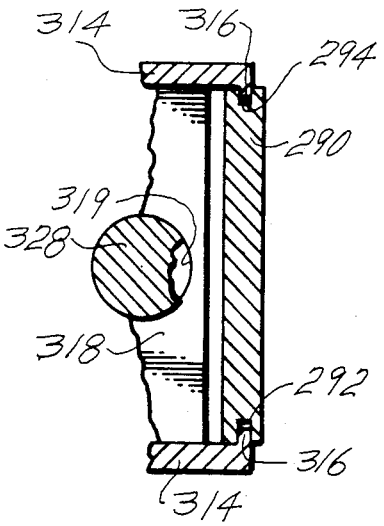
FIG. 17
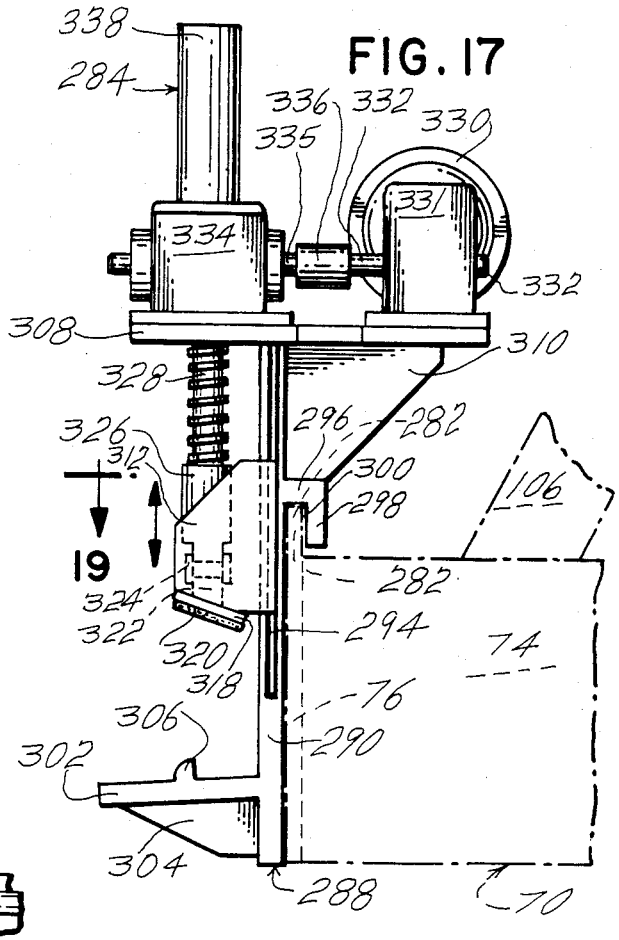
FIG. 20
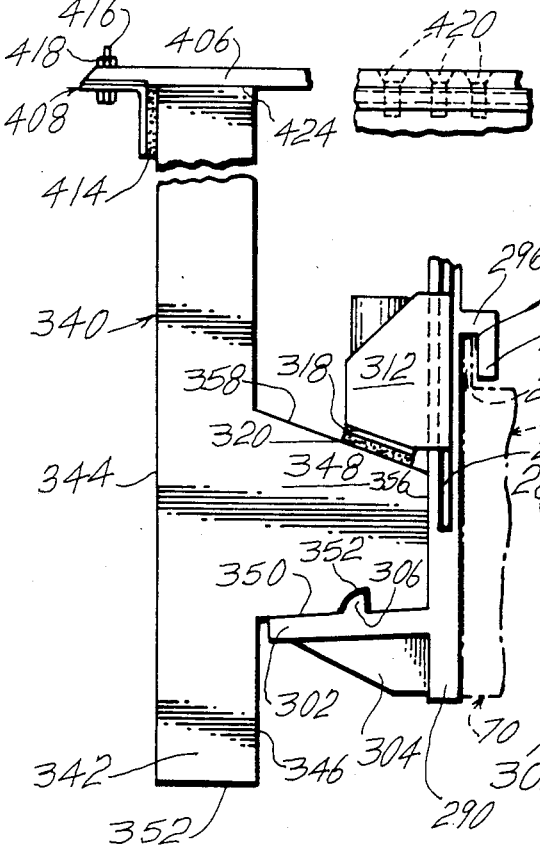
FIG. 18

APPARATUS AND METHOD FOR POSITIONING AN OBJECT IN A BUILDING

THE BACKGROUND OF THE INVENTION

In the construction of a modern building there is an opening for a precast panel. A shell of a building is constructed with openings. Then, there is placed in the openings precast panels.

In an office building, which may vary in height to many stories such as 50 or 75 stories, the shell of the building is constructed with the openings. Then, there is placed in these openings precast panels.

A precast panel may be of various sizes and thickness. An example of a precast panel is a reinforced concrete panel. This reinforced concrete panel may have a height of four feet or five feet and a length of ten feet to fifteen feet. Also, the thickness may vary from eight inches to twelve inches. The reader is to understand that the dimensions of the reinforced concrete panels can vary and are subject to the building and the requirements of the building. A reinforced concrete panel may have a weight of approximately fifteen tons. The manuevering of such a heavy reinforced concrete panel is difficult. Assume, for example, that the openings for receiving the reinforced concrete panel are at the tenth story of the building. It is necessary to lift this panel to the tenth story. Generally, in the construction of a modern high rise building there is a crane. For a building of only a few stories the crane may be on the ground. For a building of many stories the crane is on top of the building. The reader is to understand that as the height of the building increases the crane also is positioned at a higher elevation on the building. In other words, as the building increases in height, the crane positions itself on the top floor or story.

In the construction of a modern concrete and reinforced steel building there are spandrel beams. These spandrel beams are so constructed that the opening for a precast concrete panel may be as much as three feet inside the face of the spandrel beams. In other words, if a precast panel is lifted by a crane and cable, the opening for receiving the precast panel is three feet inside of the spandrel beam and it is difficult to position the precast concrete panel in the opening. A person may question why the opening is not constructed before the spandrel beam is constructed so as to receive the precast concrete panel. In this way the spandrel beam would not interfere with the manuevering and positioning of the precast concrete panel in the opening. From a construction standpoint the spandrel and the floors have to be poured four floors above the point where the opening is for the precast concrete panel. This is necessary as the shoring for the building cannot be removed until the concrete has set to a state where it will support the weight of the floors above the opening. As the spandrels in the floors have to be poured four floors above the opening for the panel the panel could not be inserted until the concrete had cured. By the time the concrete had cured the spandrel was formed and the opening for receiving the precast concrete panel could be inset as much as three feet inside the face of the spandrel beam. The spandrel beam functions as a hindrance to the insertion of the precast concrete panel into the opening in the building.

A normal method of installing a panel of this design in a recessed opening in the building would be to attach lifting rings to the top of the panel. These lifting rings would be attached with coil bolts, and the crane would be hooked to the lifting rings to lift the precast panel to a desired height in the building.

On the precast panel there is an attaching means. The crane has cables which can be attached to the attaching means on the panel. The crane by means of a cable can lift the panel to the proper height in the building under construction. The workers at the opening on the tenth story can grab onto the panel and pull the panel into the opening. Again, the panel may be large and heavy and the workers manually must pull the panel into the opening. The workers in pulling the panel into the opening may be accidently hurt and, unfortunately, may be killed.

In considering some of the problems involved with elevating the precast panels to the tenth floor I consider that proper height of the panel and use as a reference the Y-axis for the height. It is necessary to level the panel so that the panel is horizontal and in this regard I use the X-axis as an indicator of the horizontal levelling of the panel. With respect to the correct position of the precast panel in the opening of the building I use as reference the Z-axis.

The crane can lift the panel to the correct height or the correct position on the Y-axis. Then, the workers can reach out with hooks and sticks and means like that to pull the panel into the openings of the building and this is referred to as moving the panel along the Z-axis. A major problem involved is the levelling of the precast panel so that the panel is horizontal for moving into the openings in the building and the leveling is referred to the X-axis.

The movement of the panel in the Z-axis or in the opening in the building is manually achieved and is difficult. The workers are equipped with poles and hooks for grabbing onto the cables and for pulling the precast panel into the opening. The workers must lean out of the opening to try to grab onto the cable. Again, this introduces the possibility of an accident to the worker in pulling the panel along the Z-axis into the opening of the building. Also, there is introduced the possibility of an accident by trying to level the panel along the X-axis.

It is necessary, after the panel has been pulled into the opening in the building, to position the panel in the opening until the panel can be secured in place. The panel may be secured in place by welding the panels to the structure in the building or by bolting the panel to the structure in the building or by other suitable means.

Some of the shortcomings of the apparatus and method used prior to this invention is a slow process and a time consuming process to position the panel in the opening in the building. As is well known, the workers must be paid for the work of installing the panel in the building and if the process is slow and time consuming then the expense of installing a panel in the building can be a high expense.

Another shortcoming of the method and apparatus for installing a panel in an opening in a building prior to this invention is the possibility of an accident. The worker is working under dangerous conditions and may fall and be seriously hurt or killed. This possibility of an accident is undesirable and, if possible, should be eliminated.

The foregoing method of raising a panel from ground level to an opening on a building under construction consisted of a crane having cables connecting directly to the panels.

The background of the invention has been described with respect to a tenth story of a building under construction. The reader is to understand that in a taller building, say fifty stories or seventy-five stories, the panel can be elevated from ground level to the opening in the building under construction.

A BRIEF DESCRIPTION OF THE INVENTION

This invention is directed to an apparatus positioned between the cables connecting with a crane and the panel to be elevated to an opening in a building under construction. The cables connect with the crane and also with the apparatus. The apparatus has an attaching means for connecting with the panel.

Since the opening in the building may be recessed as much as three feet inside the face of the spandrel beam, I found it necessary to invent this apparatus for lifting the precast concrete panel and then positioning the precast concrete panel in the opening. This apparatus has an offset crane attachment point and a moveable counter weight that can roll back and forth the length of the apparatus to compensate for the weight of the panel. The panel is attached to the front of the machine approximately four feet ahead of the crane attachment to the apparatus. The reader can readily realize that with the panel four feet ahead of the apparatus it is possible by means of a crane to manuever the apparatus and the panel close to the opening in the building even though the opening is recessed as much as three feet inside of the spandrel beam.

The cable connecting with the crane can lift the apparatus and the panel in a vertical direction along the Y-axis. On the apparatus there is a leveling means for leveling the panel to be horizontal along the X-axis.

One configuration for this apparatus is to have the cable from the crane connect with the ring and then have four cables from the apparatus connect to the ring. As a result the panel is not directly under the cable from the crane but is offset from the cable from the crane. The apparatus and the panel can be moved along the Z-axis toward the opening in the building. The panel can be inserted in the opening in the building. It is not necessary for workmen to use rods and hooks to try to bring the panel into the opening in the building. Instead, the apparatus positions the panel in the opening. The panel can be definitely positioned in the opening in the building by means of the bolt and/or welding or other suitable means.

As is readily seen one of the advantages of this invention is that a workman need not expose himself to falling out of the opening of the building. Another definite advantage of this invention is the speed with which the panels can be inserted into the openings in the building. In a seven hour work shift fifteen panels were inserted into openings in a building under construction.

Again, the reader is to understand that the opening in the building can be at any reasonable height such as the tenth story, twenty-fifth story, fiftieth story or seventy-fifth story, depending upon the building.

THE DRAWINGS

In the drawings:

FIG. 17 is a fragmentary side elevational view of a first means of the apparatus for clamping a precast panel for elevation to an opening for a building;

FIG. 18 is a fragmentary top plan view of the gear-head motor, gear box and screw of said first means;

FIG. 19 is a fragmentary horizontal cross-sectional view illustrating the guides and part of the screw of the first means;

FIG. 20 is a fragmentary side elevational view of a precast panel illustrating a slot and a ledge for cooperating with the first means of the apparatus;

Figure 21:
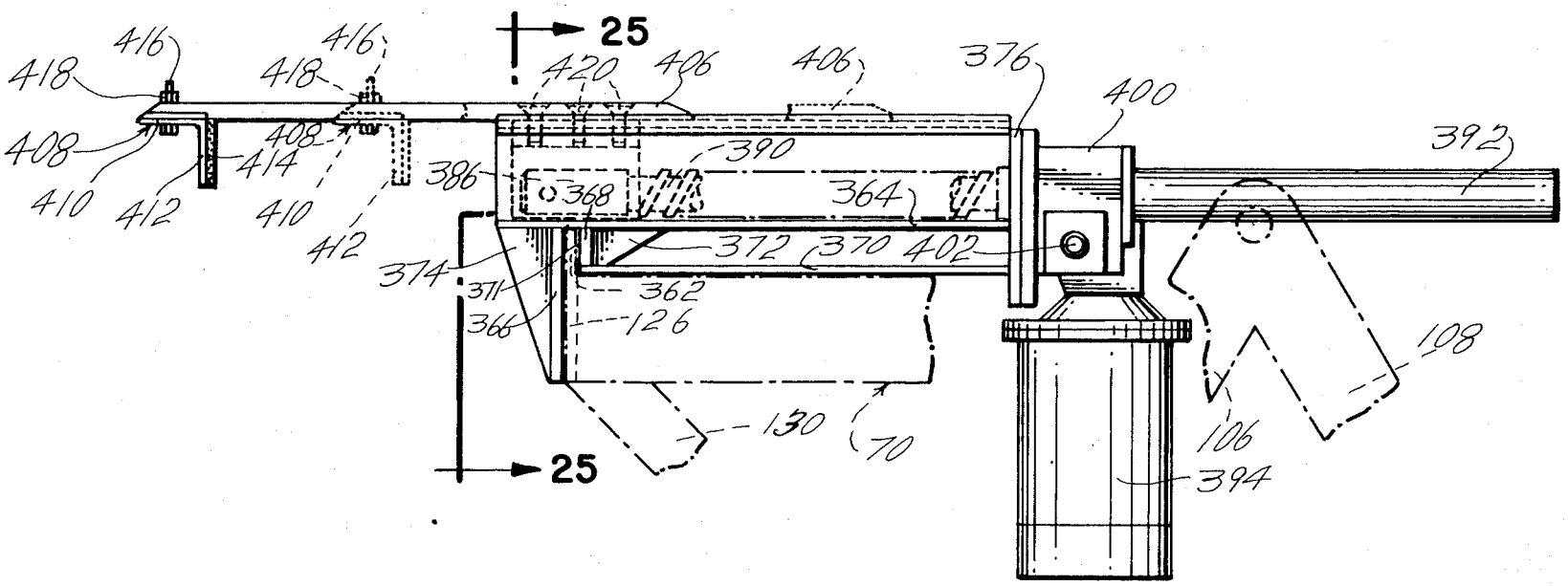
FIG. 21 is a fragmentary side elevational view of an upper part of a positioning means for positioning the upper part of a precast panel.
Figures 23, 24, 25, 26, 27:
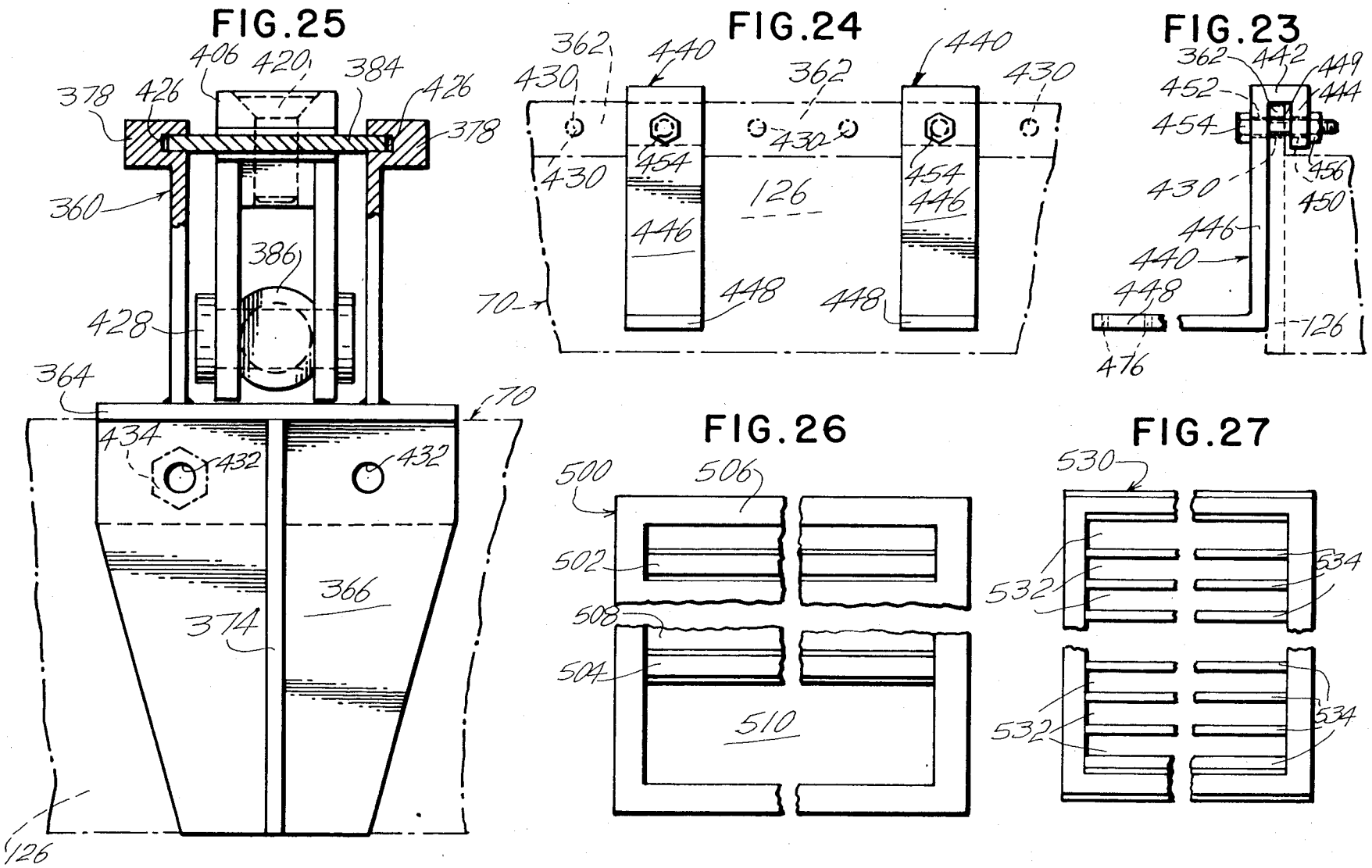
FIG. 23 is a fragmentary side elevational view illustrating support forks attached to the front of the frame and supported by the frame of the apparatus.
FIG. 24 is a fragmentary front elevational view of the support forks of FIG. 23.
Figure 28:
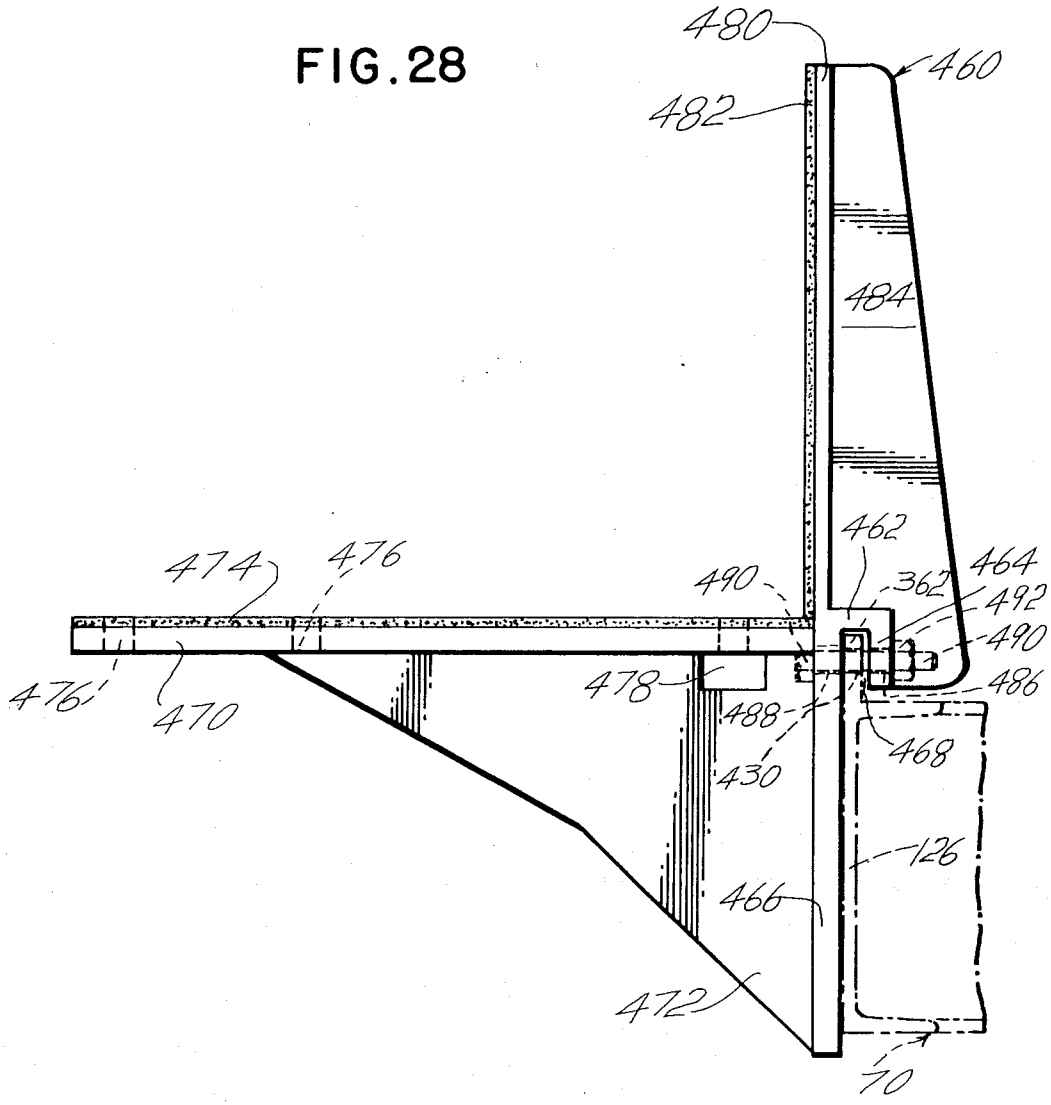
Figure 29:
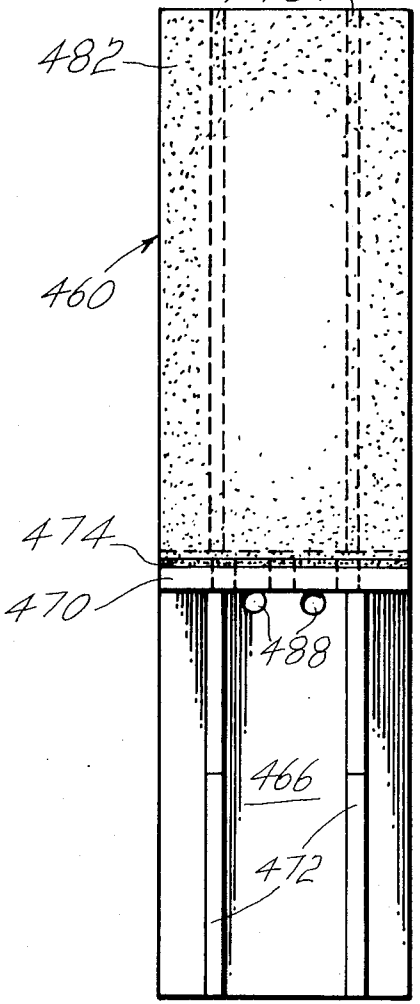
Figure 30:
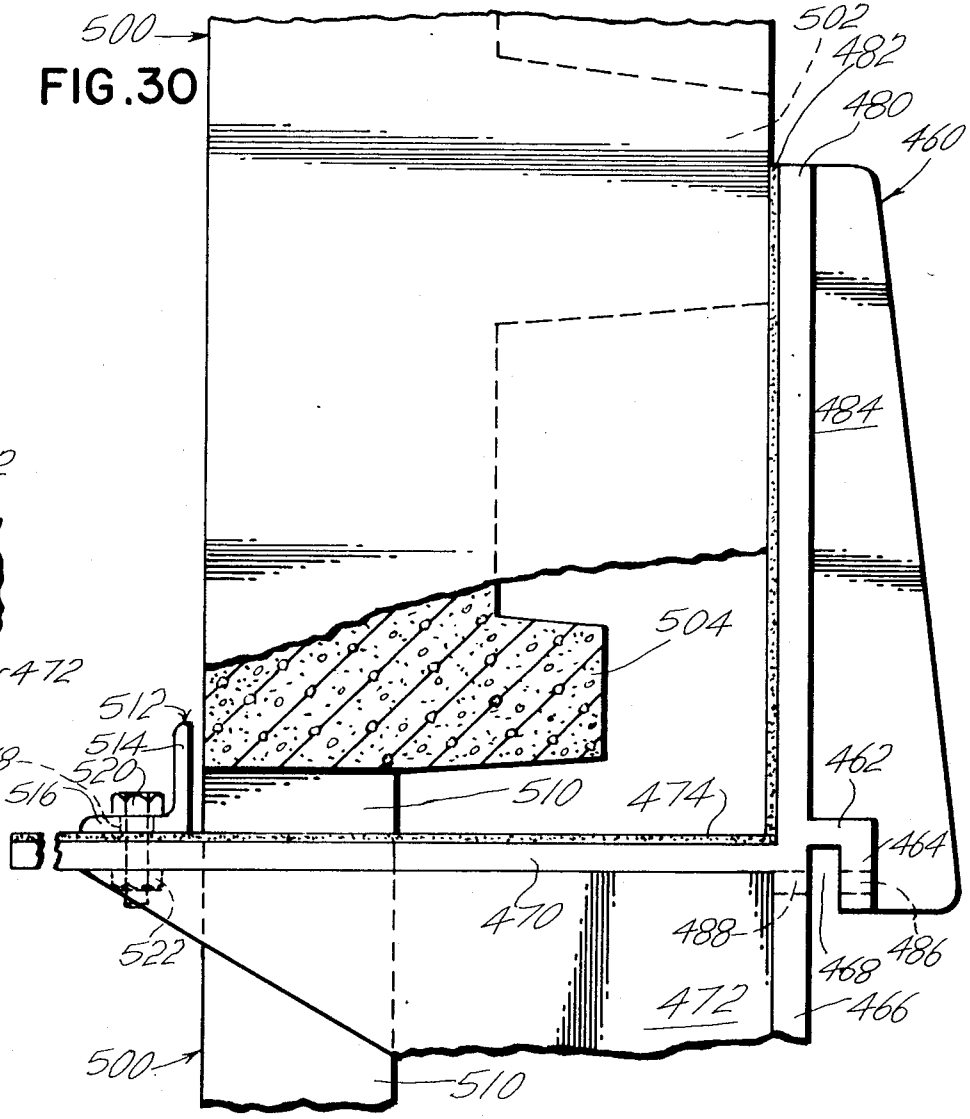
Figure 31:
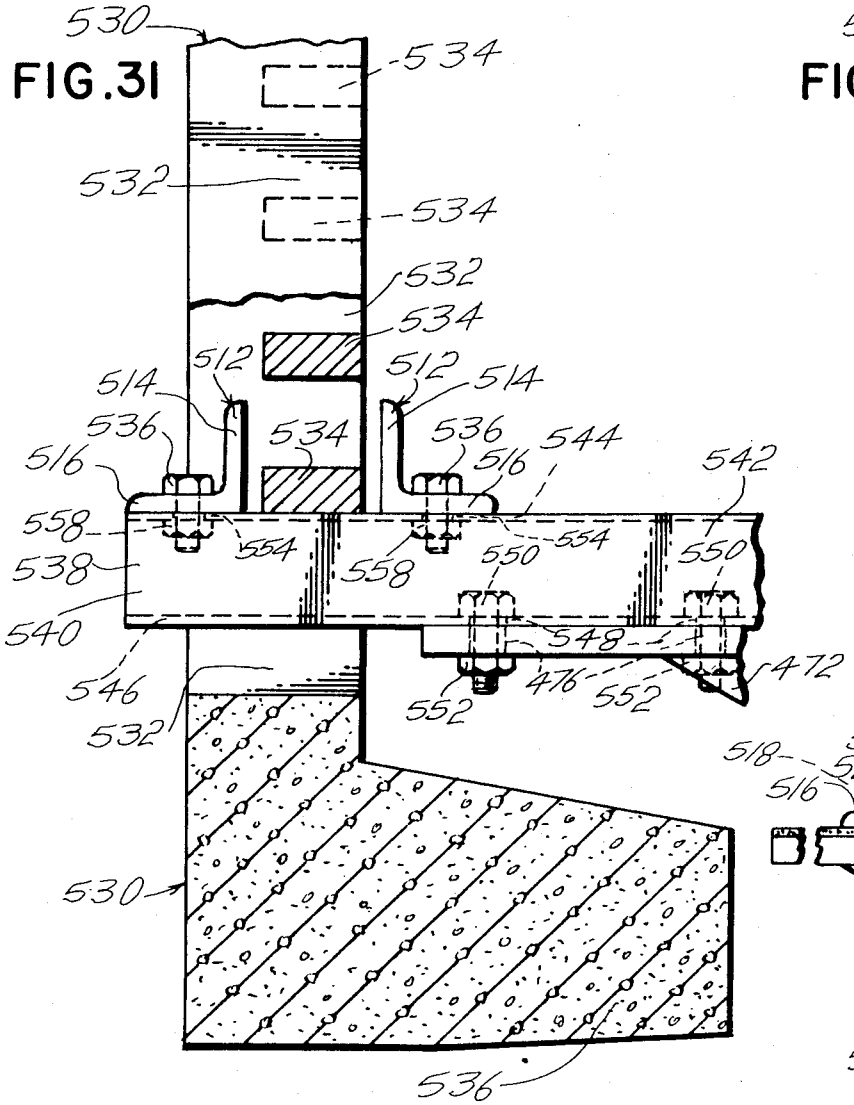
Figure 32:
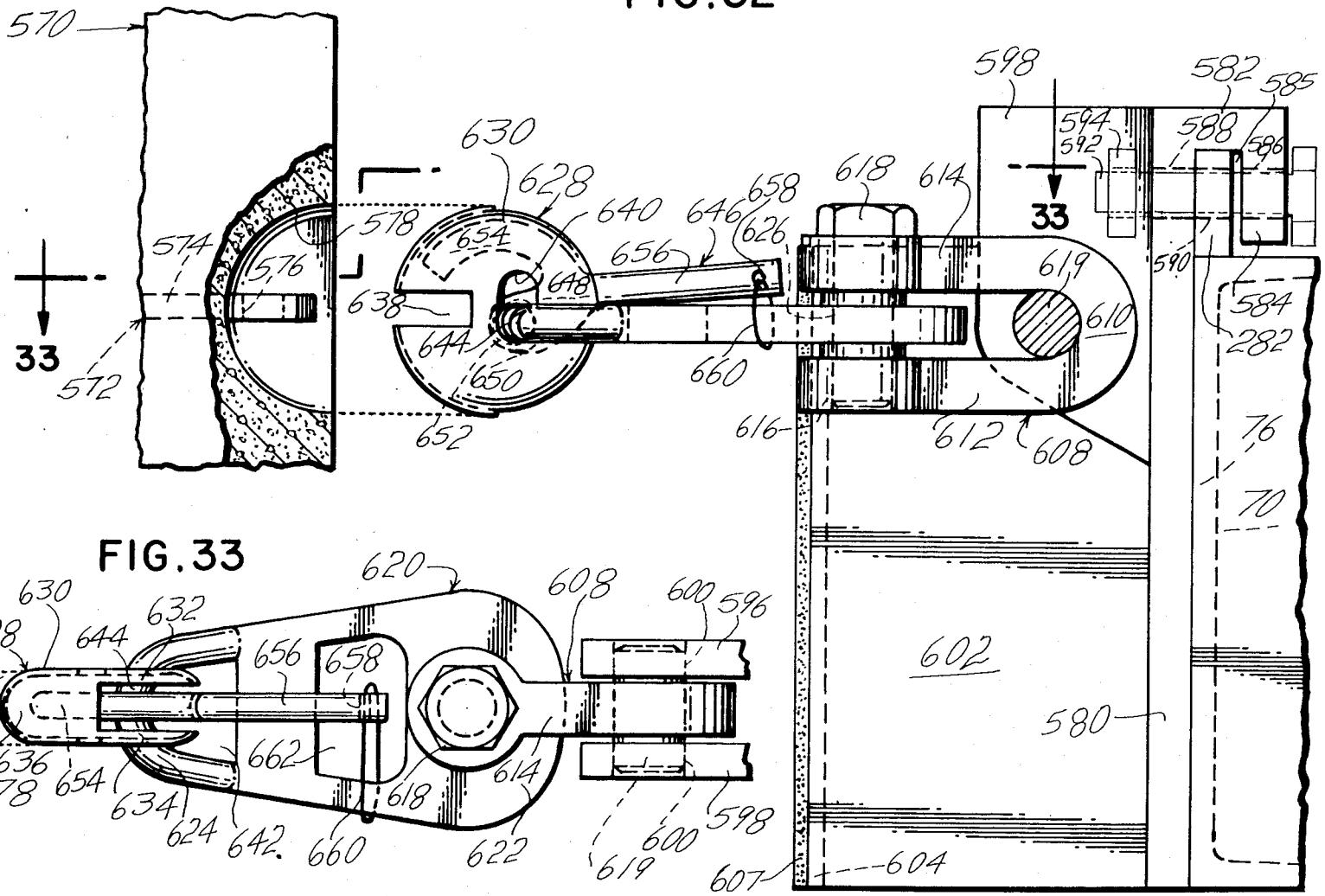
Figure 33:
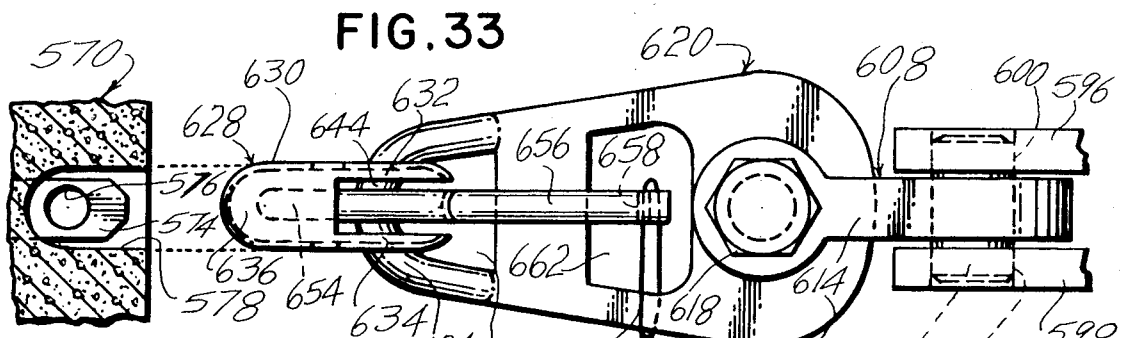
Figure 34:
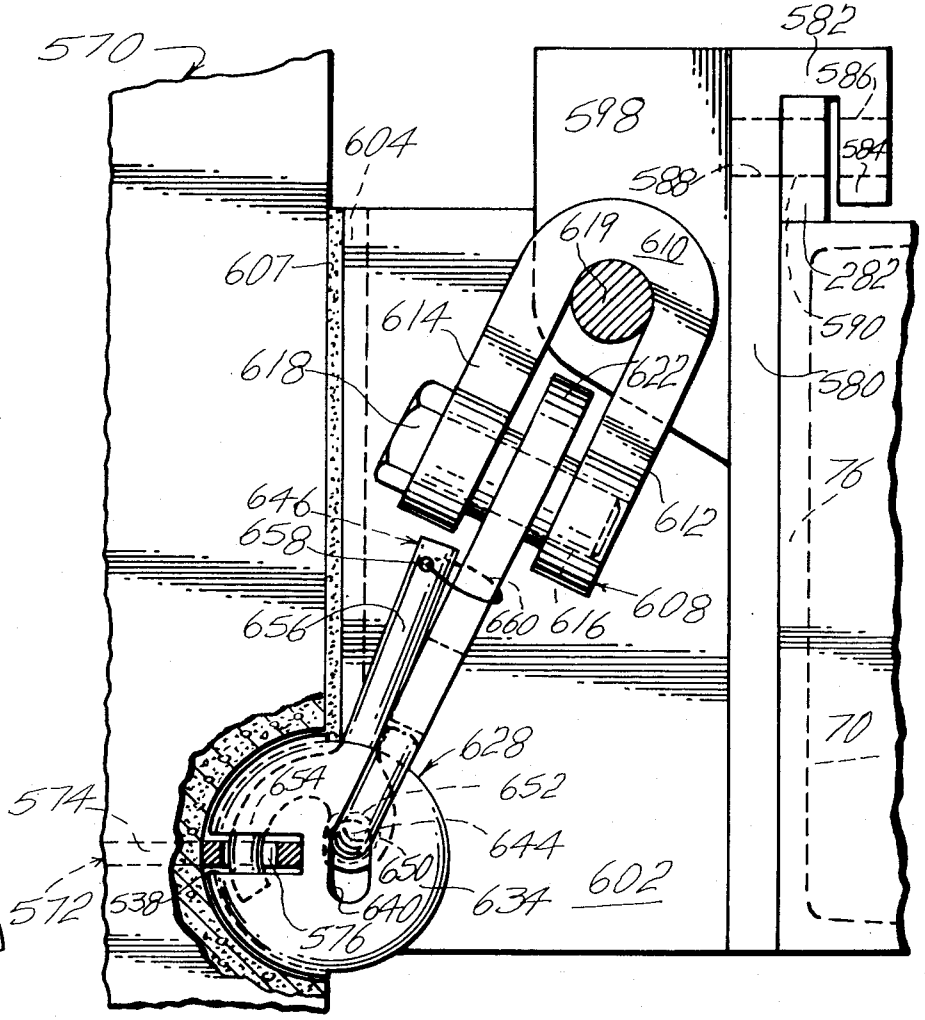
Figure 35:
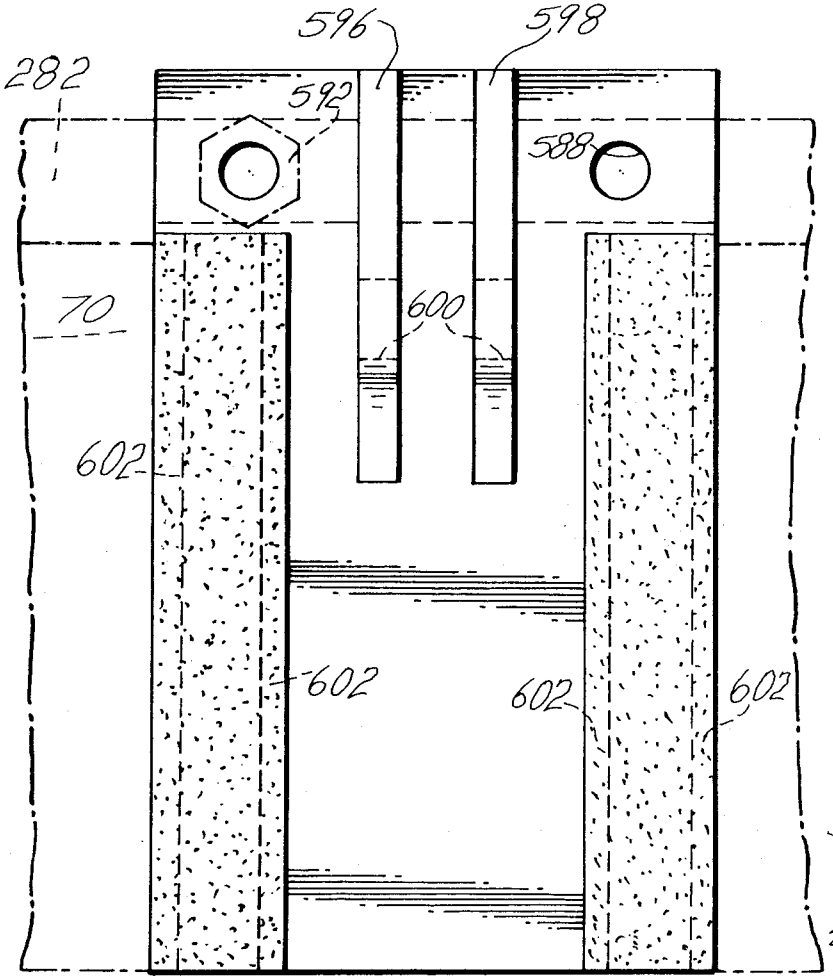
Figure 36:
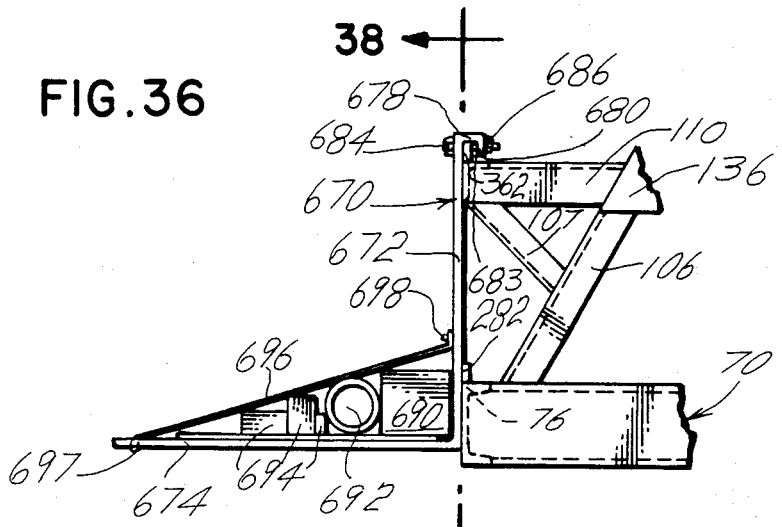
Figure 37:
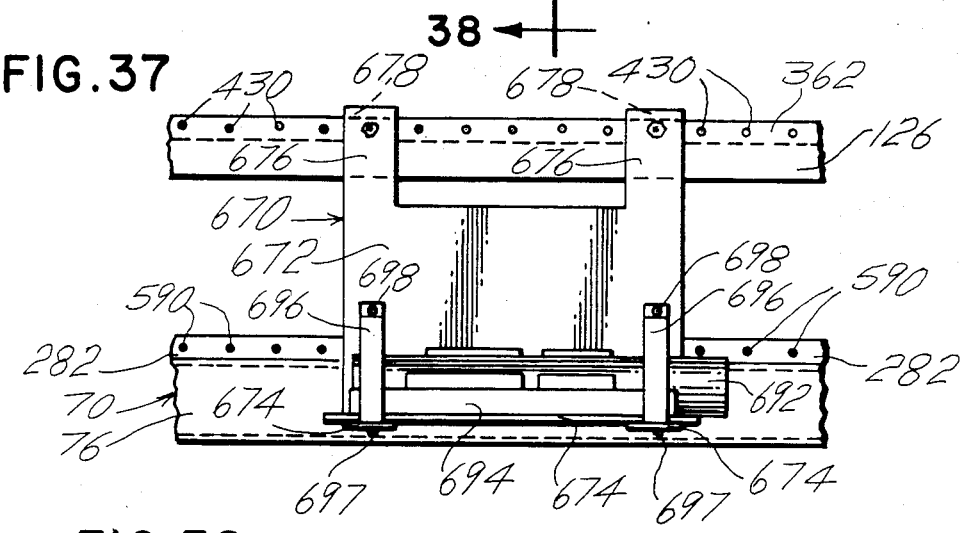
Figure 38:
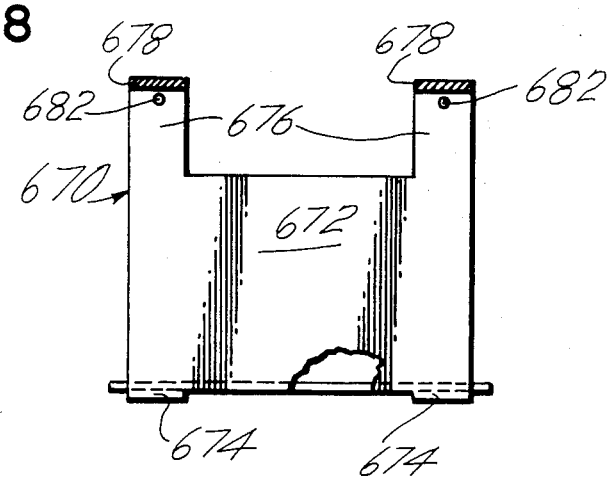
Figure 39:
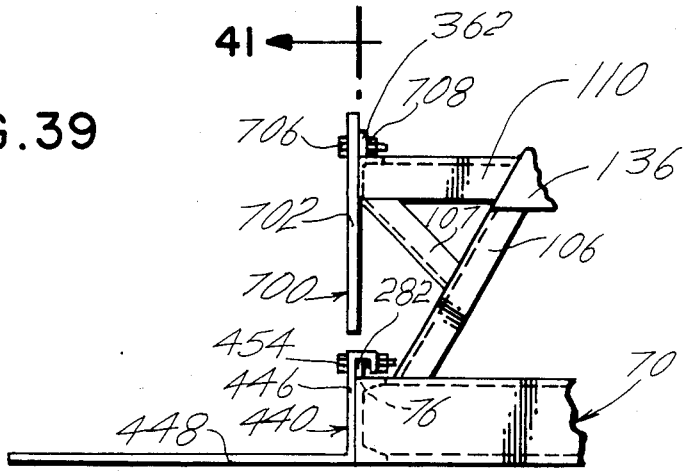
Figure 40:
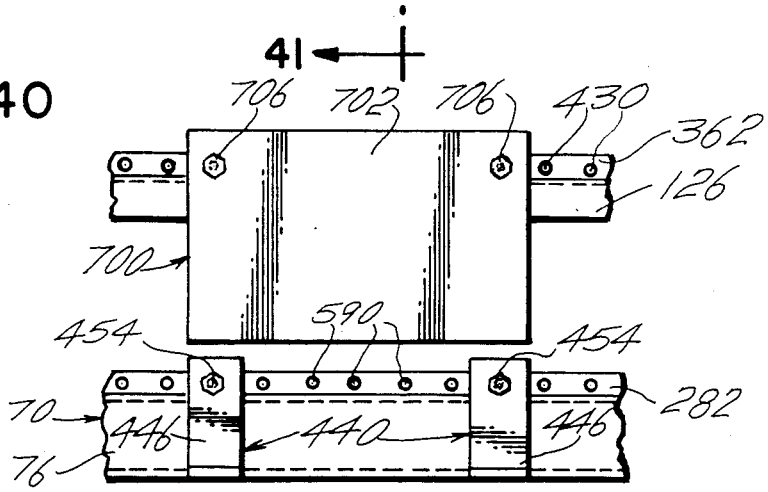
Figure 41:
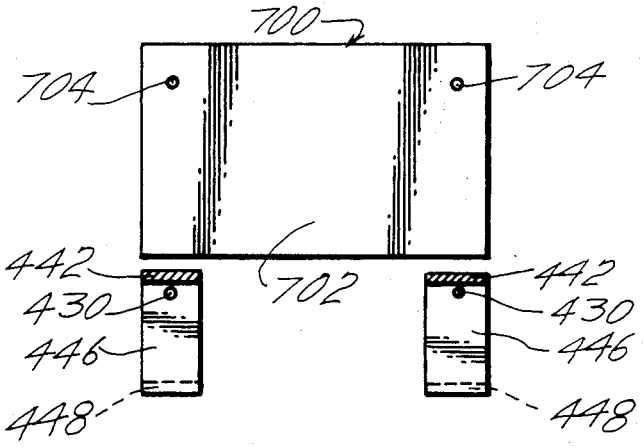
Figure 42:
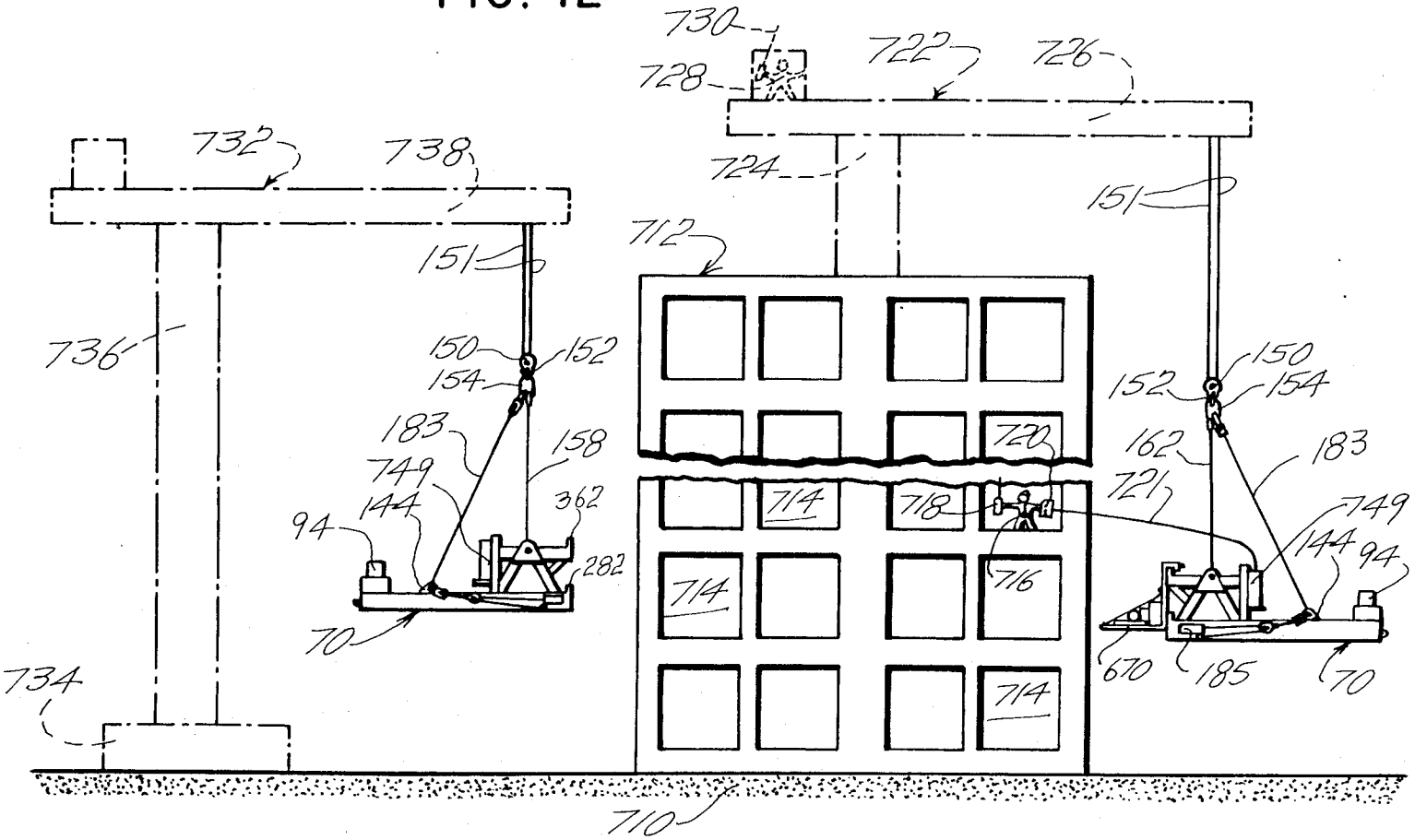
Figure 43:
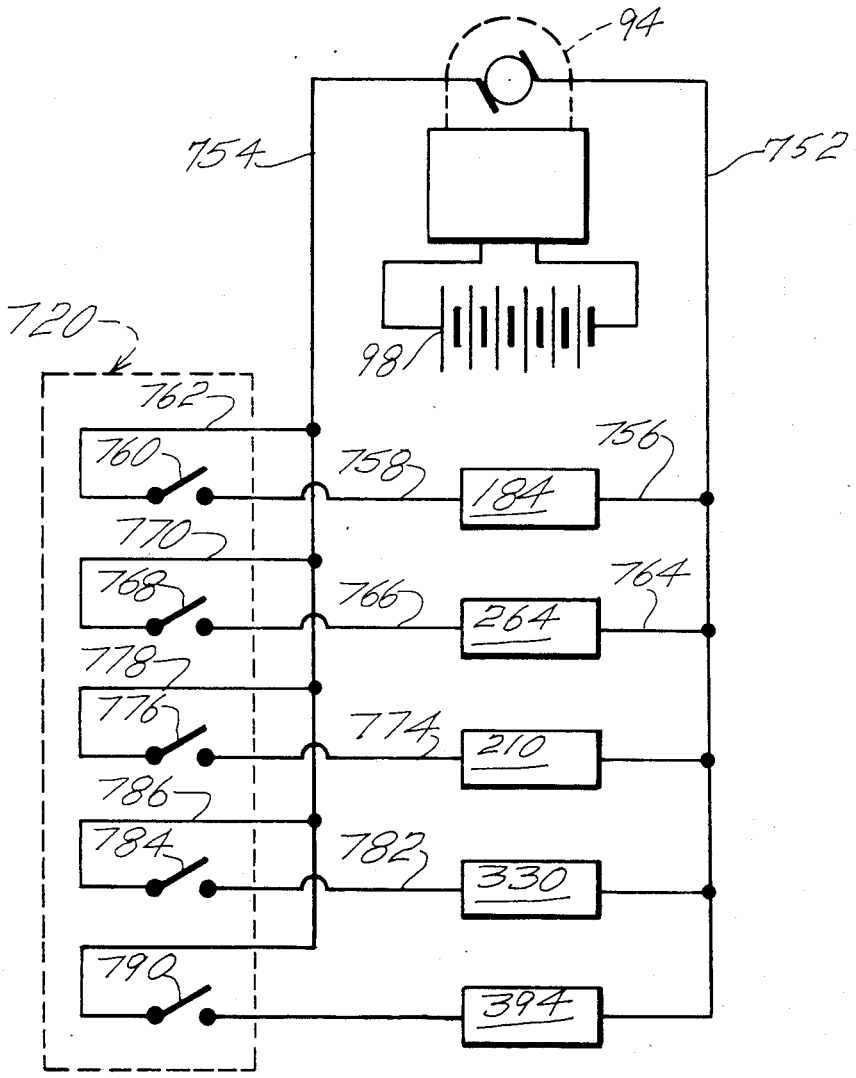

FIG. 25 taken on line 25—25 of FIG. 21, is a vertical lateral cross-sectional view of the upper member;

FIG. 26 is a fragmentary front elevational view of a precast panel having an opening for a window;

FIG. 27 is a fragmentary front elevational view of a precast panel having an opening and metal bars across the opening;

FIG. 28 is a side elevational view of a support which can be attached to the frame of the apparatus;

FIG. 29 is a front elevational view of the support of FIG. 28;

FIG. 30 is a fragmentary vertical cross-sectional view of the precast panel of FIG. 26 and with a lifting fork projecting through an opening for a window;

FIG. 31 is a fragmentary vertical cross-sectional view of the precast panel of FIG. 27 and with a lifting fork projecting through the opening and in a supporting position to one of the metal bars;

FIG. 32 is a fragmentary side elevational view of a precast panel having an integral "Burke Flatfoot" anchor juxtapositioned to a "Burk Rapid Lift" clutch mounted on a support attached to the front end of the frame of the apparatus;

FIG. 33 is a fragmentary top plan view of the precast panel having the integral "Burke Flatfoot" juxtapositioned to the "Burke Rapid Lift" clutch;

FIG. 34 is a fragmentary side elevational view showing the "Burke Rapid Lift" clutch in the "Burke Flatfoot" and the support bearing against the precast panel;

FIG. 35 is a front elevational view of the support, for the "Burke Rapid Lift" clutch, as attached to the frame of the apparatus;

FIG. 36 is a fragmentary side elevational view illustrating a unitary fork lift suspended from the upper part of the frame and illustrates the forward part of the frame;

FIG. 37 is a front elevational view of the unitary fork lift positioned on the front part of the frame;

FIG. 38 taken on line 38—38 FIGS. 36, is a view showing the back of the unitary fork lift and a cross-sectional view of the upper cross member;

FIG. 39 is a fragmentary side elevational view of a fork lift positioned on the lower forward part of the frame and illustrated the forward part of the frame;

FIG. 40 is a front elevational view of the fork lift and a back plate associated with the fork lift;

FIG. 41, taken on line 41—41 of FIG. 39, is a view looking at the back of the back plate and the fork lift and shows in cross-section the upper cross-member;

FIG. 42 is a schematic illustration of the building under construction having openings, a crane positioned on top of the building with the invention suspended from the crane and being lifted upwardly toward an opening in the building and a worker in the opening in the building communicating with the operator of the crane and there is also illustrated a crane positioned on the ground and from the crane positioned on the ground there is suspended the invention; and, FIG. 43 is a schematic wiring diagram of the motor and generator set positioned on the apparatus and also the electric motor positioned on the apparatus with the control panel removable from the apparatus connecting with the apparatus for controlling the operation of the electric motor.

THE DETAILED DESCRIPTION OF THE INVENTION

Figure 1:
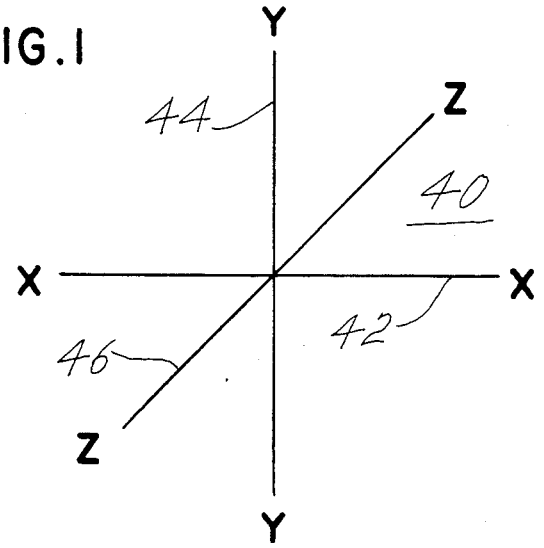
FIG. 1 is a schematic illustration of the well-known X-Y-Z axes arrangement.

In FIG. 1 of the drawings there is illustrated the well known X-Y-Z axes arrangement 40. Reference numeral 42 refers to X-axis. The Y-axis is referred to by reference numeral 44 and the Z-axis is referred to by reference numeral 46.

Figure 2:
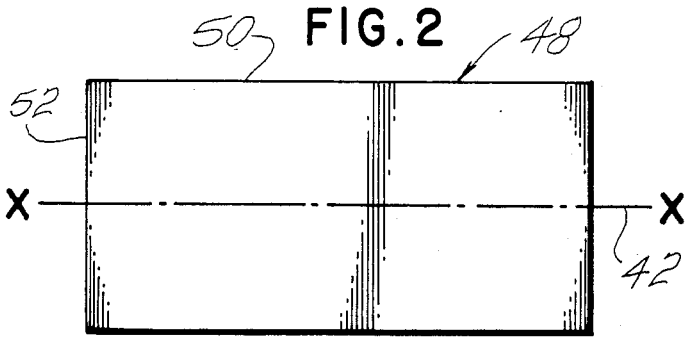
FIG. 2 is a schematic illustration of a panel being positioned horizontally with respect to the X-axis.

In FIG. 2 there is a panel 48 having long sides 50 and ends 52. The panel 48 is illustrated as being horizontal and in an alignment with the X-axis 42.

Figure 3:
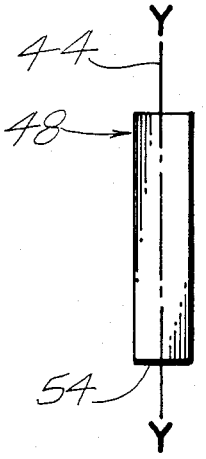
FIG. 3 is a schematic illustration of the panel being positioned vertically with respect to the Y-axis.

In FIG. 3 there is a side elevational view of the panel 48 wherein the panel 48 has a thickness 54. The panel 48 is in a vertical position and in alignment with the Y-axis 44.

Figure 4:
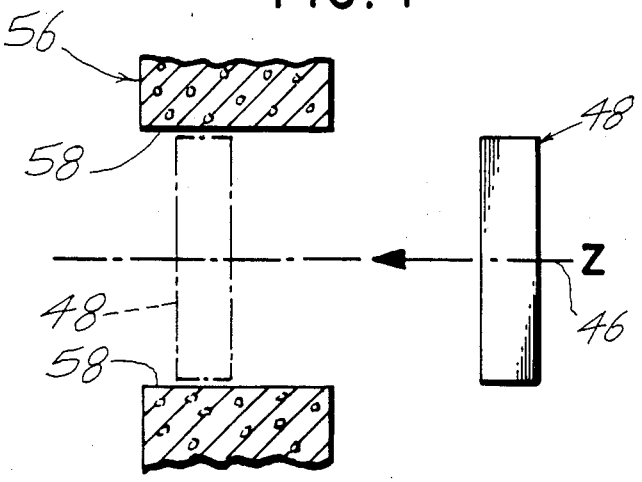
FIG. 4 is a schematic illustration of an opening in a building and a panel being moved along the Z-axis to be positioned in said opening in said building.

In FIG. 4 there is illustrated a building 56 having an opening 58. Also, there is illustrated the panel 48 being moved along the Z-axis 46 from outside of the building 56 to the opening 58 and positioned in the opening 58, in phantom line.

Figure 5:
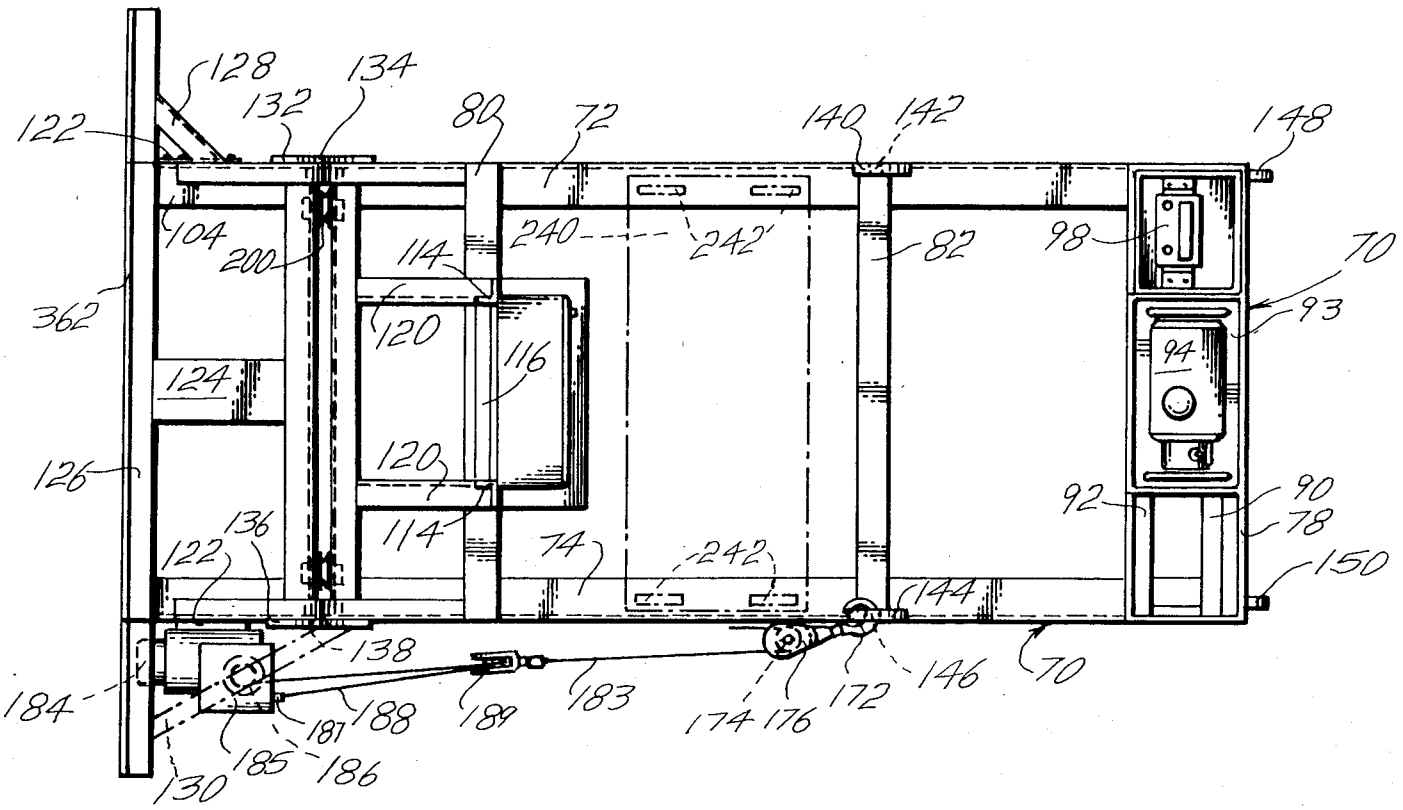
FIG. 5 is a fragmentary top plan view illustrating, primarily, the frame of the apparatus.

In FIG. 5 it is seen that there is a frame 70 having two spaced apart upright longitudinal members 72 and 74. The members 72 and 74 can be U-channel steel members.

There are a number of lateral support members 80, 82, and 84 on top of the longitudinal members 72 and 74. The lateral support members 80, 82 and 84 can be welded to 72 and 74.

Figure 6:
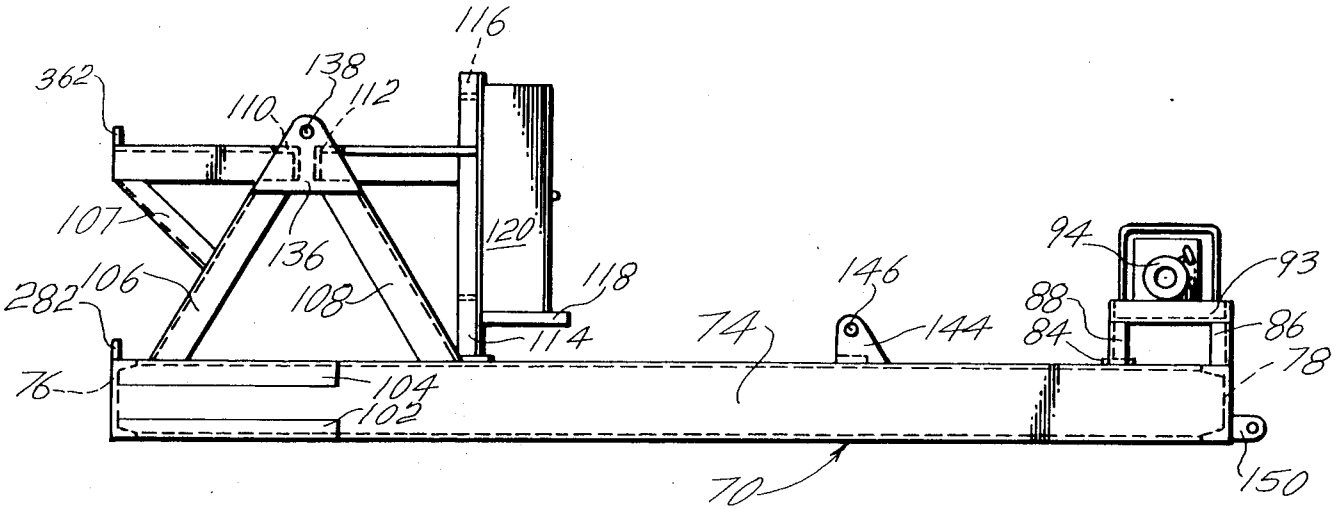
FIG. 6 is a fragmentary side-elevational view illustrating, primarily, the frame of the apparatus.

In FIG. 6 it is seen that at the left of the frame or the front of the frame 70 that there is a head-in lateral brace 76 comprising a U-channel. Also, in FIG. 6 it is seen that at the right or the tail end of the frame 70 that there is a lateral U-channel brace 78.

On the lateral braces 84 and 78 there are positioned upright legs 88 and 86. Positioned on top of the upright legs 88 and 66 are two tail end lateral supports 90 and 92. There is positioned on the lateral supports 90 and 92 a support plate 93.

An internal combustion engine and generator combination 94 is positioned on the support plate 93. A battery 98 is positioned above the combination 94.

In FIG. 6 it is seen that at the left of the frame 70 there is a lower front brace 102 and an upper front brace 104. These braces connect with the longitudinal member 72 and also connect with the longitudinal member 74.

Also, in FIG. 6 it is seen that there is a first upright brace 106 and a second upright brace 108. The braces 106 and 108 are two sets of braces. Each set of braces connects with a longitudinal member 74 and with a longitudial member 72. The lower end of the braces are spaced apart. The upper end of each of the braces are close together.

There is a forward lateral angle brace 110, in phantom line, in FIG. 6, and in solid line in FIG. 5. Also, in FIG. 6 there is a rear lateral angle brace 112, in phantom, and in solid lines in FIG. 5.

In FIG. 5 it is seen that there are two spaced apart upright angles 114. On the upper ends of the angles 114 is a lateral upper connecting brace 116. On the rearward side of the two spaced apart upright angles 114 is a support ledge 118. There is positioned on the support ledge 118 an electrical box 120.

In FIG. 5 it is seen that there are two elevated spaced apart forwardly directed braces 122. One of the braces 122 connects with longitudinal member 72. The other brace 122 connects with the longitudinal member 74.

In FIGS. 5 and 6 it is seen that there is a center diagonal brace 124 which connects with the forward lateral brace 110 and also with an upper forward lateral brace 126. The brace 126 is on the front of the frame 70.

In FIG. 5 it is seen that there is a right side diagonal brace 128 which connects with the longitudinal rail 72 and also with the lateral brace 126.

Again, in FIG. 5 it is seen that there is a left side diagonal brace 130 which connects with the longitudinal member 74 and the lateral brace 126.

In FIG. 5 it is seen that there is a gusset 132 having an eye 134. The gusset 132 is positioned near the braces 110 and 112 and acts as a reinforcing plate. Also, the eye 134 makes it possible to attach a hook to the gusset 134.

In FIGS. 5 and 6 it is seen that there is a forward left side gusset 136 positioned near the braces 110 and 112. In the gusset 136 there is an eye 138 which makes it possible to attach a hook to the gusset and to assist in lifting the frame 70.

It is seen that on the upper part of the longitudinal member 72 and near the lateral brace 82 there is a central right side lug 140 having an eye 142. The eye 142 makes it possible for the lug to receive a hook to assist in lifting the frame 70.

In FIGS. 5 and 6 it is seen that on the upper surface of the longitudinal member 74 that there is a central left side lug 144 having an eye 146. The eye 146 makes it possible to attach a hook to the lug 144 to assist in lifting the frame 70.

Figure 7:
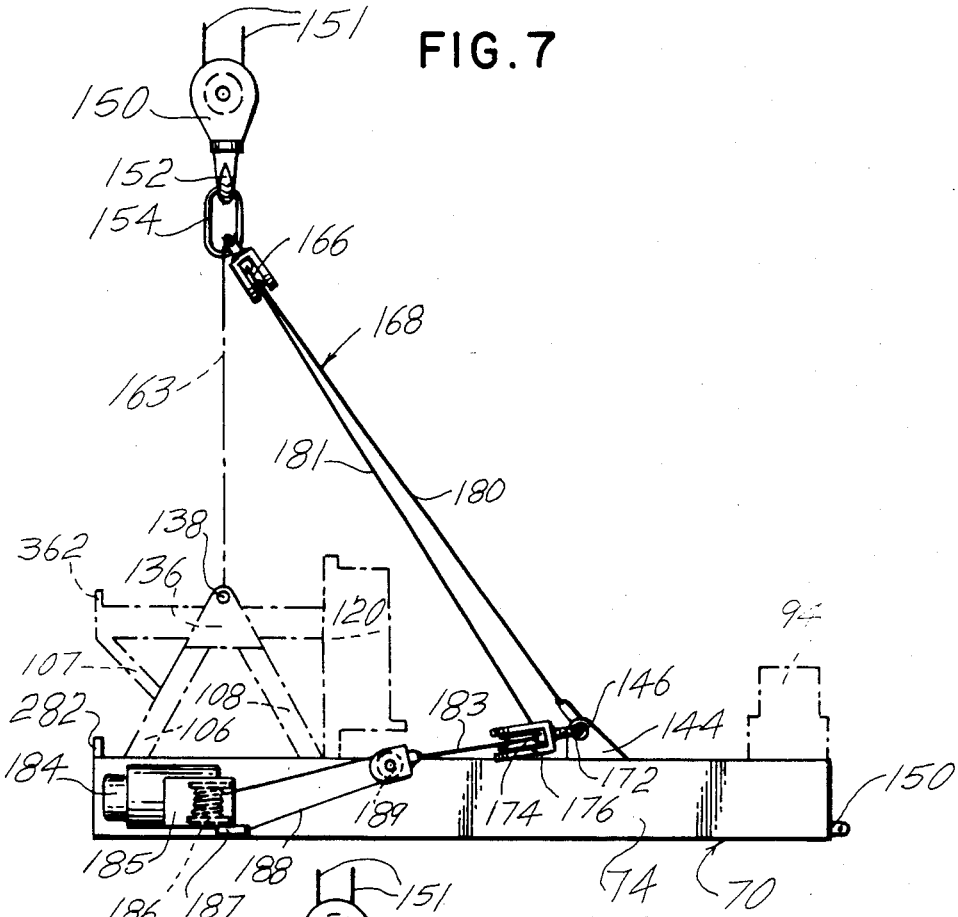
FIG. 7 is a side elevational view illustrating part of the suspension system of the apparatus from a crane.

In FIG. 7 there is a fragmentary side elevational view showing the frame 70, in phantom, as part of the suspension system.

In FIG. 7 there is a side elevational view illustrating the suspension system for the frame 70. There is a pulley 150. By varying the length of the wire cable 151 it is possible to vary the height of the frame 70. Also, the reader is to understand that by varying the angle of the crane the height of the frame 70 can be varied.

A hook 152 is attached to the lower part of the pulley 150. The hook 152 passes through a link 154.

Figure 11:
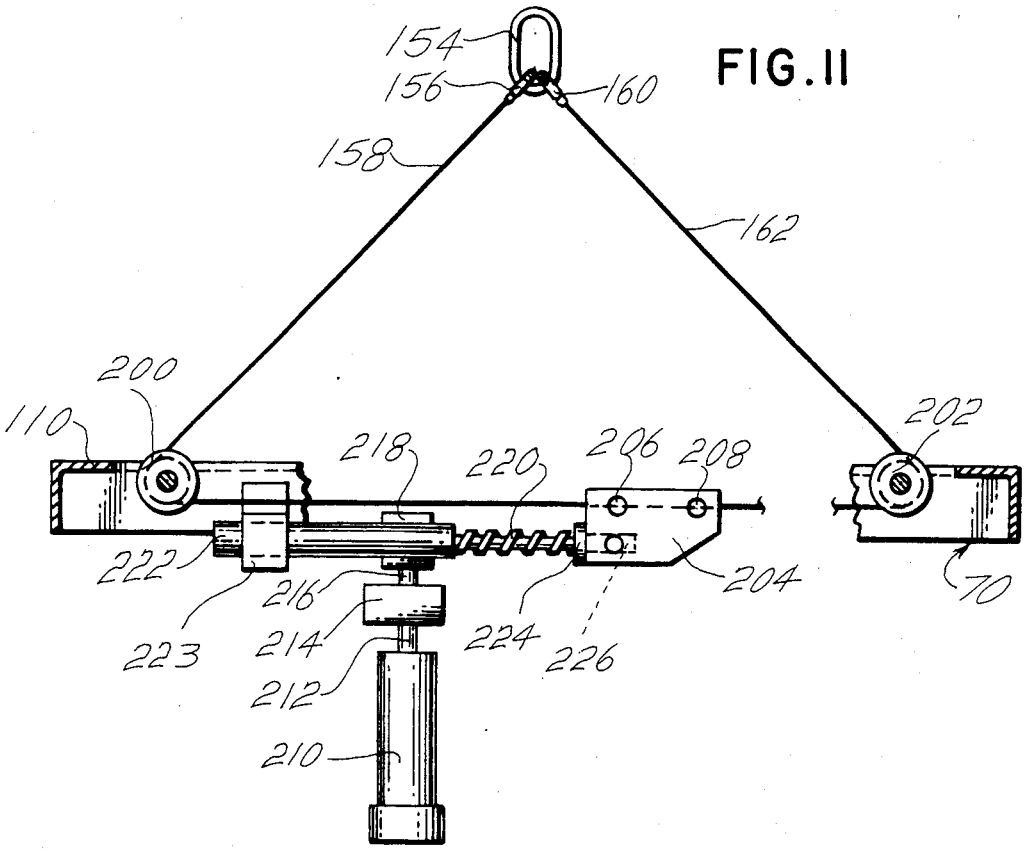
FIG. 11 is a fragmentary schematic illustration of the suspension system of the apparatus for levelling the apparatus on the X-axis.

In FIG. 11 there is a front elevational view of the suspension system of the frame 70. It is seen that there connects with the link 154 a right safety hook 156. A cable 158 connects with the right safety hook 156.

A left safety hook 160 connects with the link 154. A cable 162 connects with the left safety hook 160.

Figure 10:
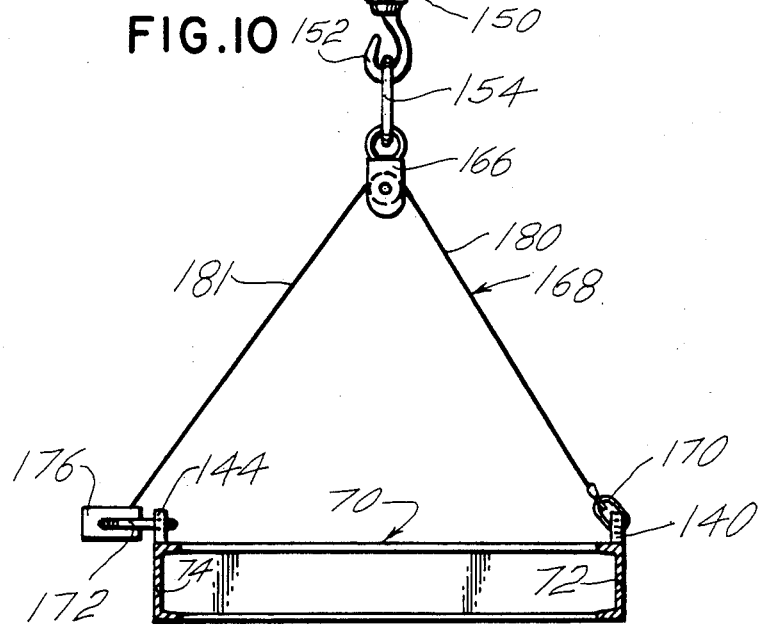
FIG. 10 is an end elevational view illustrating the suspension system for the frame of the apparatus to the hook on the end of a cable attached to a crane.

In FIG. 10 there is a rear elevational view showing the suspension system for the frame 70. It is seen that there is a pulley 166 connecting with the link 154. A cable 168 passes over the pulley 166. A safety hook 170 connects with the end of the cable 168 and also with the eye 142 of the central right side lug 140.

In FIG. 7 and in FIG. 10 there is illustrated the pulley 166 connecting with the link 154. There is a shackle 172 connecting with the eye 146 of the central left side lug 144. There is a pulley 174 positioned near the shackle 172. There is a housing 176 for the pulley 174. The housing 176 connects with the shackle 172.

The cable 168 has a fixed end connecting with the safety hook 170. That part of the cable 168 between the safety hook 170 and the pulley 166 is referred to by reference numeral 180. The cable 168 passes around the pulley 166. The cable 168 has a movable part 181 between the pulley 166 and the pulley 174. The movable part 181 passes around the pulley 174 and connects with a shackle 182. Reference numeral 183 is assigned to that part of the cable which has passed around the pulley 174 and connects with the shackle 182.

On the left front part of the frame 70 and on the outside of the longitudinal upright member 74 there is mounted a motor 184 which connects with a gear box 185. A drum 186 is positioned on the gear box 185. There is a lug 187 attached to the lower front brace 102. A cable 188 connects with the lug 187. A pulley 189 is held by shackle 182. The cable 188 upon leaving the lug 187 passes around the pulley 189 and then connects with the drum 186.

Figure 8:
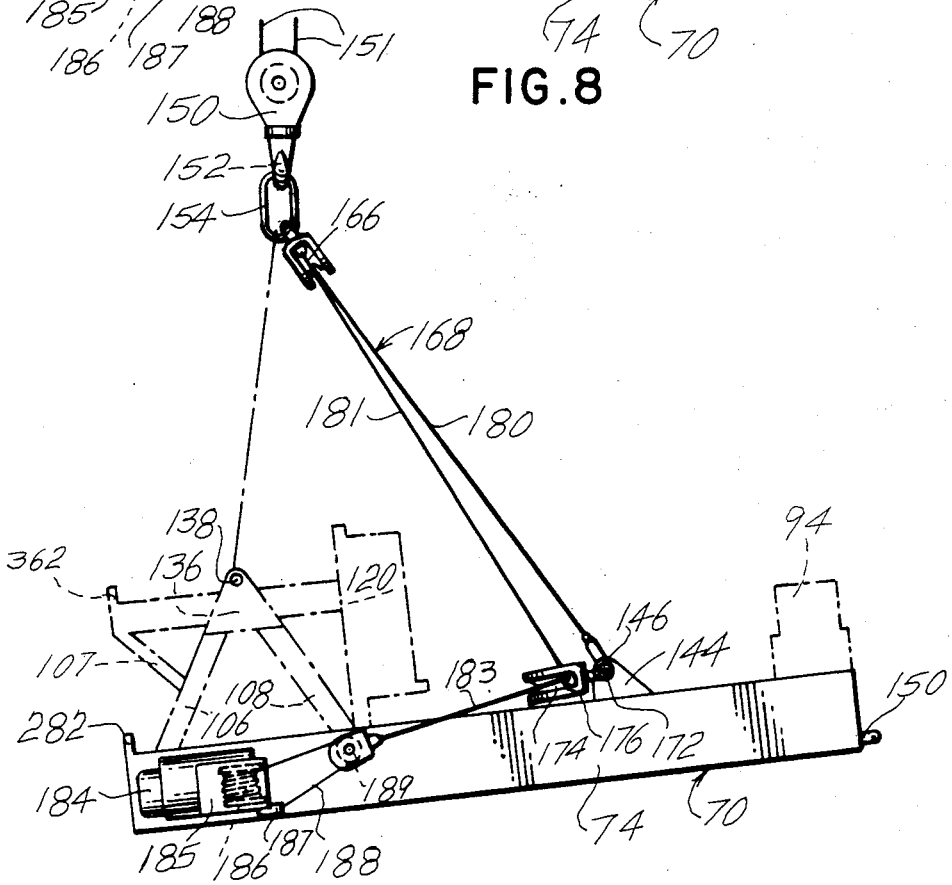
FIG. 8 is a fragmentary schematic side elevational view illustrating the tilt of the apparatus, downwardly, from right to left.
Figure 9:
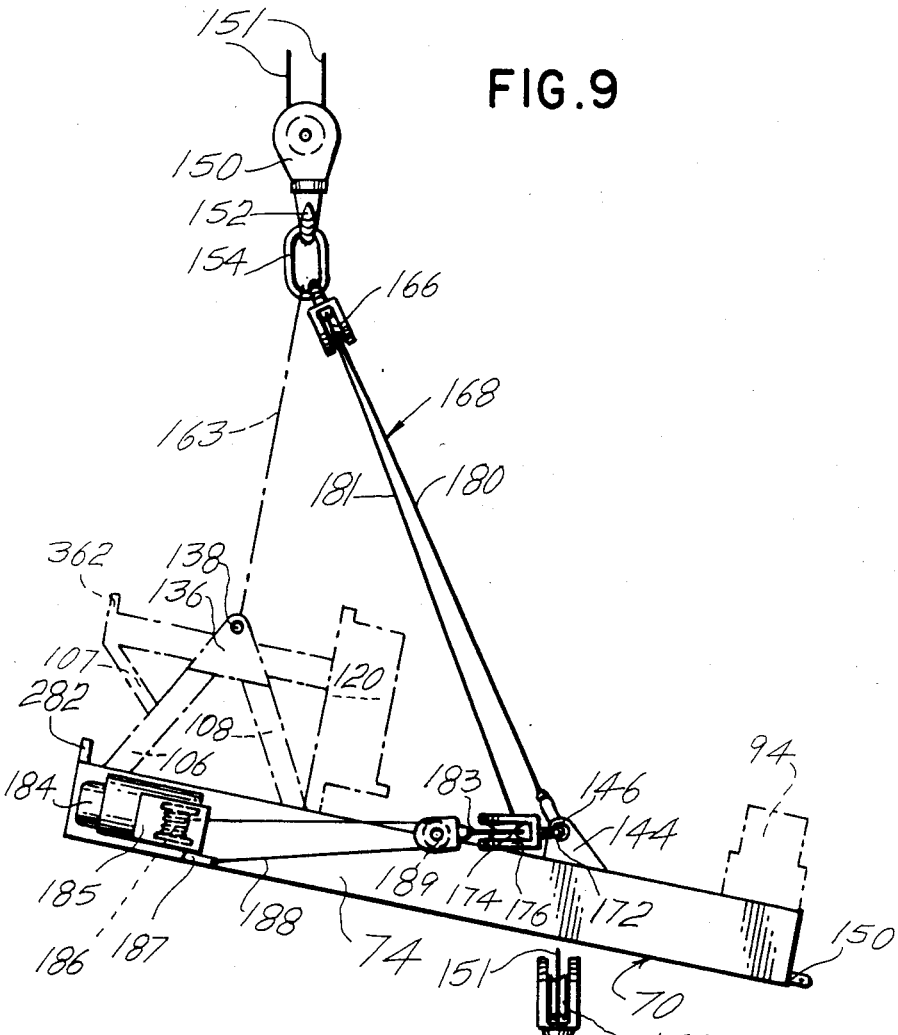
FIG. 9 is a fragmentary schematic side elevational view illustrating the tilt of the apparatus, downwardly, from left to right.

In FIGS. 7, 8 and 9 the frame 70 can be moved with respect to the horizontal and also with respect to the longitudinal axis of the frame. In FIG. 7 the longitudinal axis of the frame 70 is horizontal. With the rotation of the drum 186 so as to wind cable 188 around the drum 186 the cable 188 is shortened an thereby the length of the cable 181 between the pulley 166 and the pulley 174 is shortened and the length of the cable 168 between the pulley 166 and the pulley 174 is shortened. The result is that the rear of the frame 70 moves upwardly so that the rear of the frame 70 is at a higher elevation than the front of the frame 70, see FIG. 8.

In FIG. 9 some of the cable 188 has been released from the drum 186 or some of the cable 188 has been unwound from the drum 186. This means that the length of the cable 181 between the pulley 174 and the pulley 166 and the length of the cable 180 between the pulley 166 and the lowered safety hook 170 has lengthened so that the rear of the frame 70 is lower and the rear of the frame 70 is at a lower elevation than the front of the frame 70.

The foregoing discussion with respect to FIGS. 7, 8 and 9 and the movement of the frame 70 along the longitudinal axis can also be considered the movement of the frame 70 and the levelling of the frame 70 along the "Z" axis.

In FIG. 11 it is seen that there is a right front pulley 200 and a left front pulley 202. There is a movable plate 204.

On the movable plate 204 there is a right cable stopper 206 which connects with the free end of the cable 158.

On the movable plate 204 there is a left cable stopper 208 which connects with the free end of the cable 162.

The reader can readily see that the cable 158 passes around the right front pulley 200 and connects with the right cable stopper 206. Likewise, the reader can readily see that the pulley 162 passes around the left front cable 202 and connects with the left cable stopper 208.

There is an electric motor 210 having an output shaft 212 which connects with a gear box 214. The gear box 214 has an output shaft 216 which connects with a gear box 218. There is a screw 220 which connects with the gear box 218 and is rotated by the gear box 218. There is a housing 222 for the screw 220. The housing 222 is mounted on the forward lateral angle brace 110 by a bracket 223.

In FIG. 11 it is seen that at the left of the movable plate 204 there is welded a threaded nut 224. The screw 220 is screwed into the threaded nut 224. As the reader readily appreciates with the turning of the screw the movable plate 204 moves and, likewise, the cables 158 and 162 move. With the movement of the cables 158 and 162 the center of gravity is changed on the frame 70. In this manner it is possible to have the "X" axis of the frame 70 positioned horizontally. In the movable plate 204 there is a guide 226 for the screw 220.

In FIG. 11 it is illustrated the movement of the frame around the "X" axis or the movement of the frame along the lateral dimension. In FIG. 11 it is seen that the frame 70 is horizontal with respect to the "X" axis.

Figure 12:
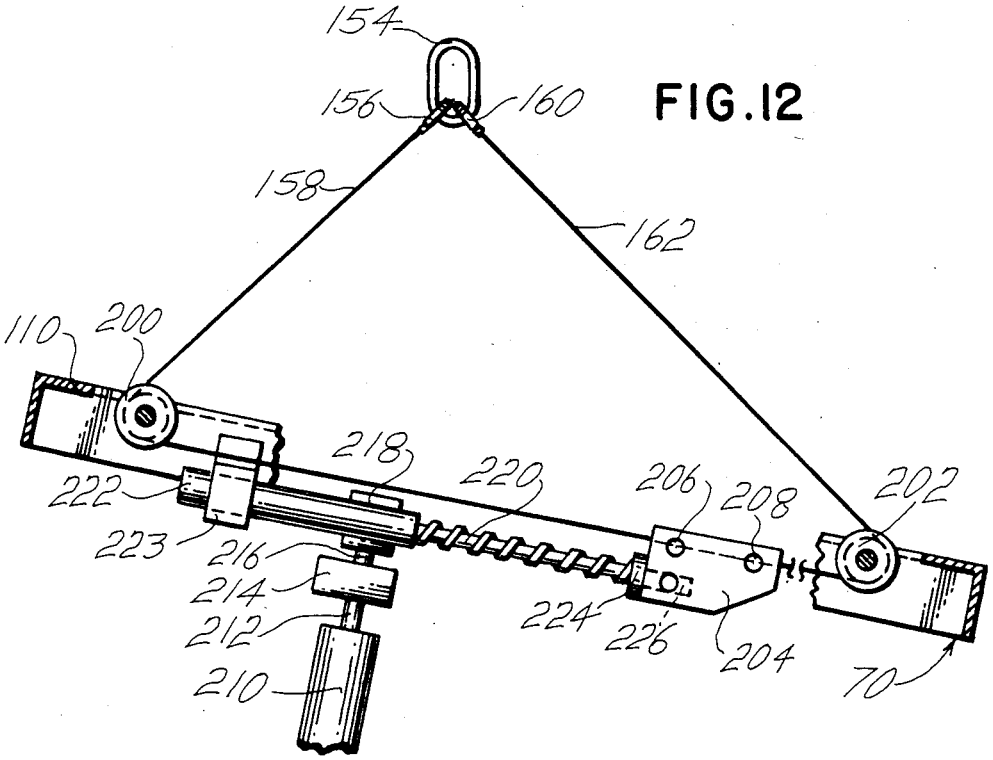
FIG. 12 is a fragmentary schematic illustration of the suspension system for the apparatus on the X-axis and showing the tilt of the apparatus, downwardly, from left to right.

In FIG. 12 the movable plate 204 has been moved by the rotation of the screw 220 so that the movable plate 204 is closer to the front pulley 202. This increases the length of the cable 158 between the link 154 and the pulley 200 but also lessens the length of the cable 162 between the link 154 and the pulley 202. The result is that the left front pulley 202 is allowed to be at a lower elevation than the right front pulley 200 and therefore, in FIG. 12, the frame 70 appears such that the frame is tilting downwardly from the right front pulley 200 to the left front pulley 202.

Figure 13:
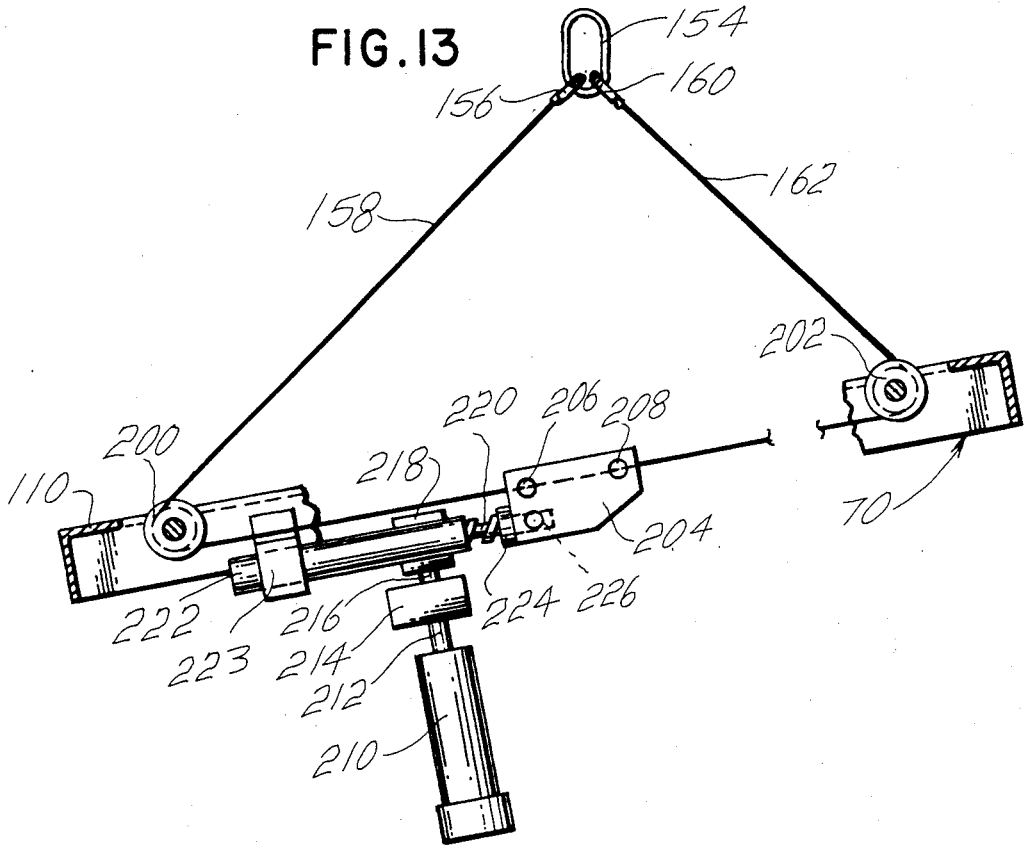
FIG. 13 is a fragmentary front elevational view of the apparatus and the suspension system of the apparatus and showing the tilt of the apparatus, upwardly, from left to right.

In FIG. 13 the screw 220 has been rotated so that the movable plate 204 is drawn or moved toward the right front pulley 200. This increases the length of the cable 162 between the link 154 and the left front pulley 202 and lessens the length of the cable 158 between the link 154 and the right front pulley 200. The result is that the right front pulley 200 is at a lower elevation than the left front pulley 202. The frame 70 tilts downwardly from the left front pulley 202 to the right front pulley 200.

From this description with respect to the screw 220, the movable plate 204, the cables 162 and 158 it is seen that the frame 70 can be rotated so that the lateral axis or the "X" axis can be horizontal depending upon the lengths of the cables 162 and 158.

Figure 16:
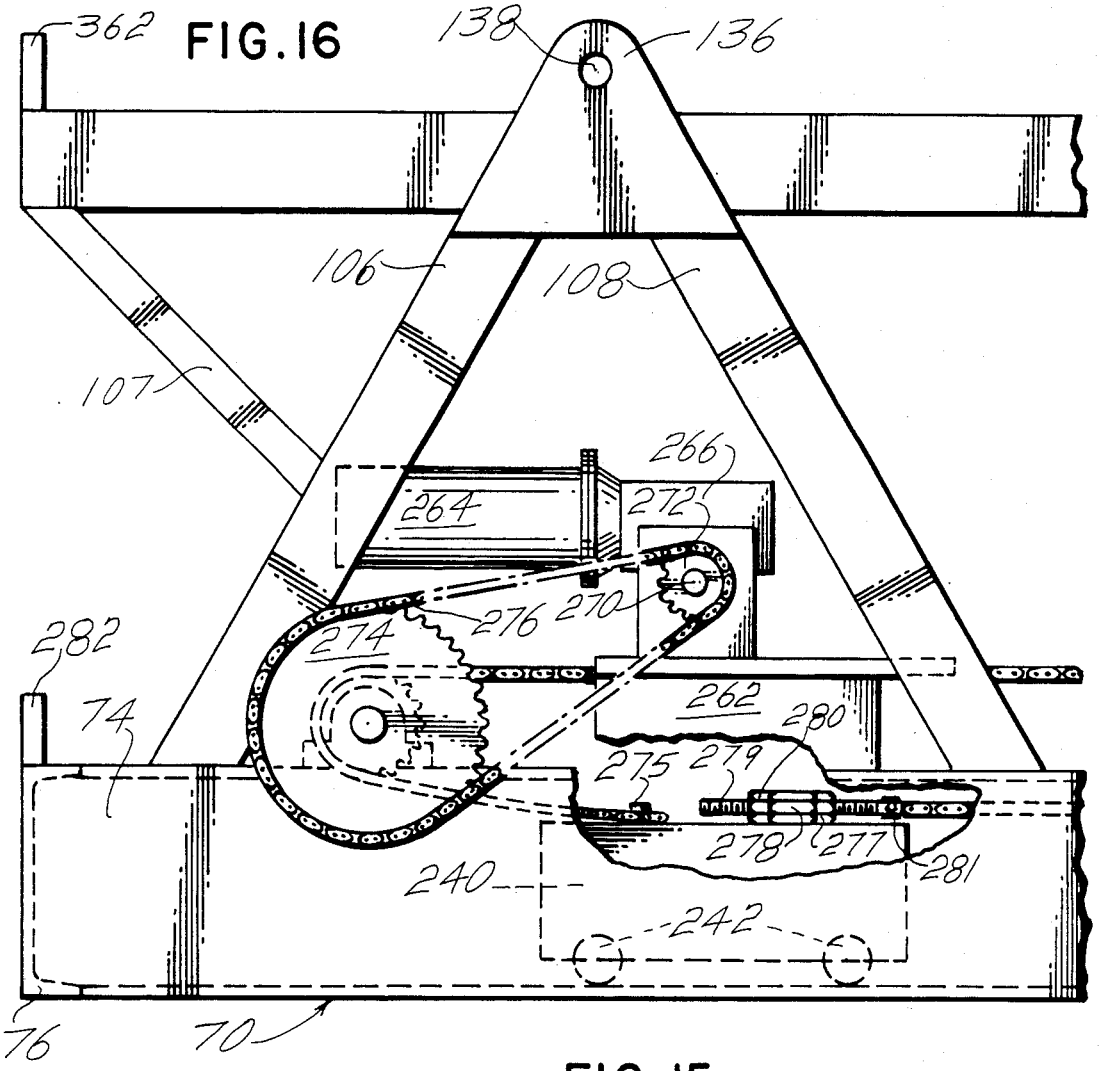
FIG. 16 is a fragmentary side elevational view of the frame and the counterweight.
Figure 15:
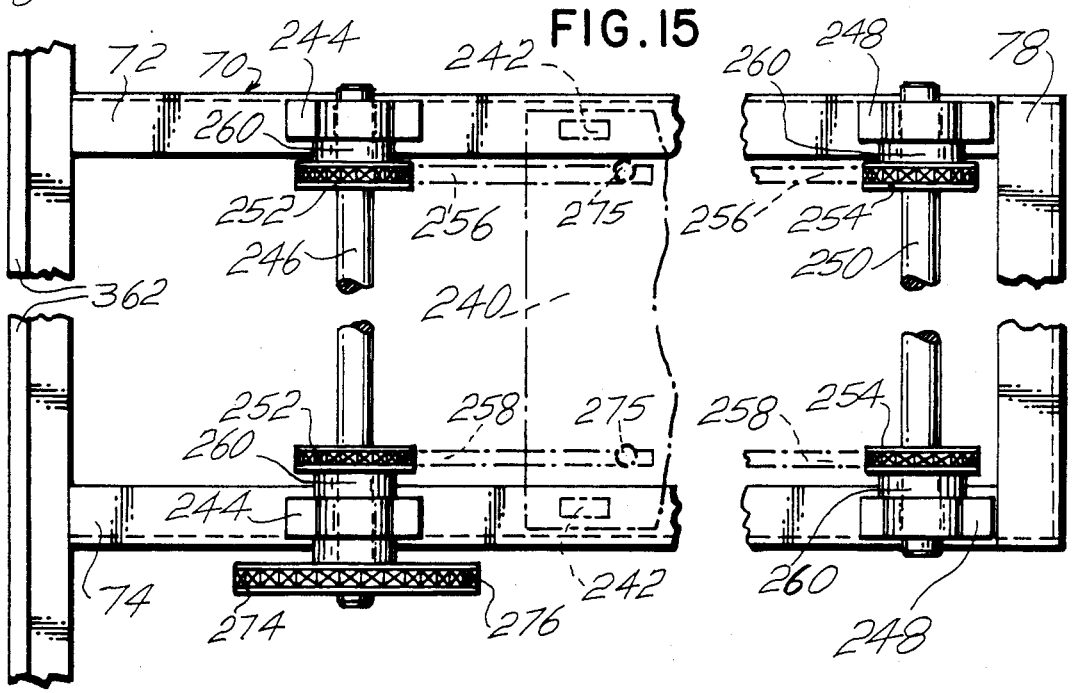
FIG. 15 is a fragmentary top plan view of the frame and the frame and the counterweight.

In FIGS. 5, 15 and 16 there is illustrated a counterweight system for placing the frame 70 at tne desired angle in the "Z" axis. With the counterweight system it is possible to have the frame 70 horizontal or tilted in the "Z" axis system.

In FIGS. 5, 15 and 16 it is seen that there is a counterweight 240 positioned on four wheels 242.

The counterweight 240 can be a box of steel filled with concrete.

On the upper surface of the two spaced apart longitudinal members 72 and 74 are positioned spaced apart forward bearings 244. In the forward bearings 244 are forward shafts 246.

Also, on the upper surface of the two spaced apart longitudinal members 72 and 74 are spaced apart rear bearings 248. There is positioned in the rear bearings 248 a rear shaft 250.

On the forward shaft 246 and near the longitudinal members 72 and 74 are positioned two spaced apart forward sprockets 252. Also, on the rear shaft 250 near the longitudinal members 72 and 74 are positioned two spaced apart rear sprockets 254.

A right chain 256 runs around the sprockets 252 and 254 which are near the longitudinal member 72.

A left chain 258 runs around the sprocket 252 and 254 near the longitudinal member 74.

Between the bearings and the sprockets 252 and 254 there is positioned a spacer 260 to maintain the sprockets in a spaced apart relationship with the bearings. The spacers 260 are outlined in FIG. 15.

On the longitudinal member 74 and near the first upright brace 106 and the second upright brace 108 there is a support platform 262. In FIG. 16 it is seen that there is a motor 264 which connects with a gear head 266. The gear head 266 connects with a gear box 268. The gear box 268 has an output shaft 270. There is mounted on the output shaft 270 a sprocket 272.

In FIGS. 15 and 16 it is seen that on the forward shaft 246 there is mounted a sprocket 274 outside of the longitudinal member 74. A chain 276 runs around the sprocket 272 and also the sprocket 274. The sprocket 272 is in a driving relationship with the sprocket 274.

There are forward fasteners 275 which connect with the left chain 258 and with the right chain 256 with the top of the counterweight 240. A pin 276 connects the fastener 275 to the counterweight 240. Also, there are rear fasteners 277 which connect with the left chain 258 and with the right chain 256. A nut 278 is welded to the top of the counterweight 240 to be a fixed nut 278. A screw 279 connects with the rear fastener 277 and is free to rotate. The screw 279 is screwed into the fixed nut 278. With the rotation of the appropriate screw 279 the tension in the appropriate chain 256 or 258 can be adjusted. A locking nut 280 is screwed onto the screw 279 at the free end of the screw. A locking nut 281 is screwed onto the screw 279 at the chain end of the screw. With the screw 279 at the right position in the fixed nut 278 and the appropriate tension on the chain the locking nuts 280 and 281 can be rotated to bear tightly against fixed nut 278 to fixedly and to securely position the screw in the fixed nut 278.

The wheels 242 run on the upper surface of the lower legs of the channel members 72 and 74. By directing the motor 264 the sprocket 272 can rotate in a clockwise direction to rotate the sprocket 274 in a clockwise direction. This moves the chains 256 and 258 towards the front of the frame 70 and likewise moves the counterweight 240 towards the front of the frame 70.

With proper direction the motor 264 can be controlled so as to rotate the sprocket 272 in a counterclockwise direction with the result that the sprocket 274 rotates in a counter-clockwise direction. Then, the right chain 256 and the left chain 258 move the counterweight 240 towards the rear of the frame 70.

The levelling of the frame 70 in a horizontal position along the "Z" axis is roughly approximated by the moving of the counterweight 240. The final levelling of the frame 70 to a horizontal position along the "Z" axis is realized by the drum 186 pulling on the cable 188. By the motor 184 rotating the drum 186 in a clockwise direction the cable 188 and like-wise the part 183 of the cable 178 are moved towards the drum 186. The result is that the front of the frame 70 becomes higher and the rear of the frame becomes lower. The fine levelling of the frame 70 is achieved by the motor 184 and the drum 186. If the drum 186 is rotated in a counter-clockwise direction the cable 188 and the part 183 of the cable 178 moves towards the shackle 172 and the pulley 174. Then, the rear of the frame becomes lower and the front of the frame 70 becomes higher.

To recapitulate the counterweight 240 is positioned so as to approximate the desired position of the frame 70 with respect to the "Z" axis. Then, by rotating the drum 186 and varying the length of the cable 188 the desired position of the frame 70 with respect to the "Z" axis is achieved. In certain instances, it may be desirable to have the forward end of the frame 70 lower than the rear end of the frame 70. In other situations, it may be desirable to have the rear end of the frame 70 lower than the forward end of the frame 70. Also, under other conditions it may be desirable to have the frame 70 substantially horizontal in the "Z" axis.

In FIGS. 17–22 there is illustrated a first positioning means for positioning a precast panel. This first positioning means comprises a lower portion for positioning the lower part 284 of the precast panel and also comprises an upper portion for positioning the upper part of the precast panel.

On the forward part of the frame 70 and rising above the head end lateral brace 76 there is an upward projecting guide 282.

The lower part 284 comprises a frame 288. The frame 288 comprises an upright member 290. The upright member 290 comprises two spaced apart opposed slots 292 and 294.

On the upper part of the upright member 290 there is a outwardly directed arm 296. The arm 296 is directed towards the frame 70. Then, the arm 296 bends into a downwardly directed finger 298. The upright member 290, the arm 296 and the finger 298 define a slot 300. The slot 300 fits over the upward projecting guide 282. The frame 288 is supported on the upwardly projecting guide 282 and the back face or back surface of the upright member 290 bears against the head end lateral brace 76.

On the lower part of the upright member 290 there is an outwardly directed ledge 302. The ledge 302 is on the opposite face or surface of the upright member 290 as compared with the normal outwardly directed arm 296. Also, the outwardly directed ledge 302 slopes downwardly as it moves away from the upright member 290. There is a brace 304 on the underneath side of the ledge 302. The brace 304 may be welded to the ledge 302 and may be welded to the upright member 290. In approximately the center of the outwardly directed ledge 302 on the upper surface there is an upwardly directed guide 306. The back surface is normal to the upper surface of the ledge 302 while the front surface curves upwardly and away from the ledge 302 to meet the back surface.

On top of the upright member 290 there is an upper support platform 308. The upper support platform 308 may be welded to the upright member 290.

A brace 310 connects with the rear surface of the upright member 290 and the underneath surface of the upper support platform 308.

There is a guide 312. The guide 312 comprises spaced apart sides 314 having inwardly directed fingers 316. The inwardly directed fingers 316 are positioned in the spaced apart slots 292 and 294.

There is a cross plate 318 between the two spaced apart sides 314 of the guide 312. The cross plate 318 can be welded to the side 314. In the cross plate 318 there is a passageway 319.

There is an abrasive or friction ledge 320. The abrasive or friction ledge 320 can be rubber or a roughened metal surface or other satisfactory friction material. The abrasive or friction ledge 320 is bonded to the cross plate 318.

An upwardly directed guide 322 connects with the upper surface of the cross plate 318. The upwardly directed guide 322 can be welded to the upper surface of the cross plate 318. There is a socket 324 for receiving the upwardly directed guide 322.

There is associated with the spaced apart side 314 and the guide 312 an internally tapped housing 326. A screw 328 screws into the internally tapped housing 326.

There is an electric motor 330 which is in a driving relationship with a gear head 331. The gear head 331 is supported on the upper support platform 308. The gear head 331 may be welded to the upper support platform 308 or may be attached by nuts and bolts or other suitable means.

A gear head 331 has an output shaft 332.

The electric motor 330 and the gear head 331 may be considered a gear head motor.

There is a gear box 334 supported on the upper surface of the upper support platform 308. The gear box 334 may be welded to the platform 308 or may be connected by means of nuts and bolts or other suitable attaching means.

There is an input shaft 335 to the gear box 334. A union 336 connects the output shaft 332 and the input shaft 335 with the result that the gear head 331 is in a driving relationship to the gear box 334.

There is a housing 338 for the screw 328.

The reader can readily understand that by rotating the screw 328 the abrasive ledge 320 can be lowered toward the outwardly directed ledge 302 or the abrasive ledge 320 can be elevated away from the outwardly directed ledge 320.

In FIG. 20 there is a side elevational view of a precast panel 340 having an upright part 342. The panel 340 has an inside surface 344 and an outside surface 346. In the lower part of the precast panel 340 and directed away from the outside surface 346 there is an outwardly directed ledge 348. The ledge 348 has a lower surface 350. In the lower surface 350 there is a recess 352 for receiving guide 306 on the upper surface of the outwardly directed ledge 302. The lower surface 350 slopes upwardly as it moves away from the outside surface 346.

There is an outer vertical surface 356 of the outwardly directed ledge 348. Then, there is a downwardly sloping upward surface 358 of the outwardly directed ledge 348. The downwardly sloping upward surface 358 slopes downwardly from the outside surface 346 toward the outward vertical surface 356. The reader readily understands that rain upon hitting the outside surface 346 and also the surface 358 of the precast panel 340 will run downwardly on the surface 358 and the outward vertical surface 356 and fall downwardly.

In lifting the precast panel 340 the guide 306 is positioned in the recess 352. The reader is to understand that there are at least two spaced apart guides 306 and, if the contractor desires, there can be more than two spaced apart guides 306. Then, the screw 328 can be rotated and the abrasive ledge 320 put in contact with the downwardly sloping upper surface 358. This definitely positions the guide 306 and the recess 352 and also assists in positioning the downwardly sloping upper surface 358 because of the abrasive ledge 320 and thereby definitely positions the lower part of the precast panel 340.

Figure 22:
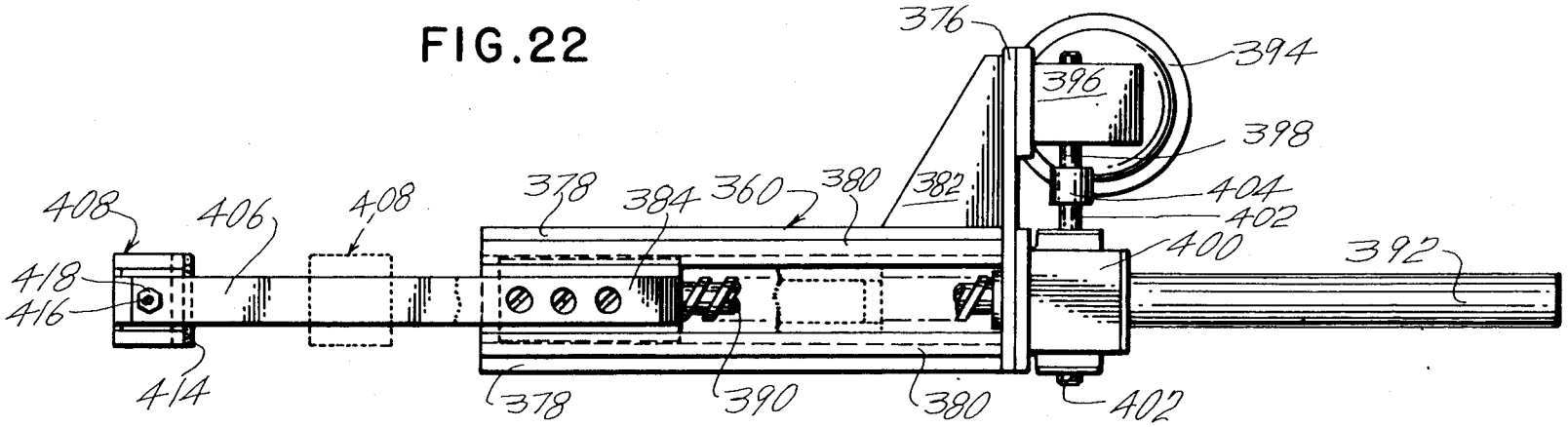
FIG. 22 is a fragmentary top plan view of the positioning means for positioning the upper part of a precast panel.

In FIGS. 21 and 22 and also in FIG. 20 there is illustrated an upper member 360 of the first positioning means for the precast panel.

On the upper part of the frame there is the upper forward lateral brace 126 extending upwardly into a projecting guide 362.

There is a lower frame member 364 of the upper member 360. There depends from the lower frame member 364 the forward downward arm 366. Also, there depends from the lower frame member 364 the rearward downward finger 368. Further, there is the lowest frame member 370 which connects with the finger 368. It is seen that the frame member 364, the downward arm 366 and the downward finger 368 define a recess 371 for fitting over and receiving the upward projecting guide 362.

A brace connects with the upper part of the lowest frame member 370, the rearward surface of the finger 368 and the lower surface of the frame member 364. The brace 372 may be welded to these members.

There is a brace 374 which connects with the forward surface of the forward downward arm 366 and also the lower surface of the lower frame member 364. The brace 374 may be welded to these members.

There is a rear frame member 376 which connects with the lowest frame member 370 and also with the lower frame member 364. The member 376 may be welded to these members 364 and 370.

There are two spaced apart side frame members 378. Then, in the side of the side frame members 378 there are two spaced apart central guides 380 which are positioned above the frame member 378. The spaced apart central guide 380 functions as a guide for the movement of a member.

There is a brace 382 connecting with the outside surface of the upper frame member 378 and also the forward surface of the rear frame member 376. The brace 382 may be welded to 378 and also may be welded to 376.

There is a guide follower 384 which moves in between the central guides 380. The guide follower 384 comprises a housing 386 for screw 390. There is a housing 392 for screw 390. The housing 386 is forward or to the left of the rear frame member 376 and the housing 392 is rearward or to the right of the rear frame member 376.

There is a gear head electric motor 394 which connects with the gear head 396. The gear head 396 has an output shaft 398.

There is a gear box 400 which has an input shaft 402. The output shaft 398 is joined to the input shaft 402 by union 404. The gear box 400 rotates the screw 390 so as to move the housing 386 away from the rear frame member 376 and also toward the rear frame member 376.

There is an upper movable positioning arm 406. On the free end of the arm 406 there is an L-member 408 having a first arm 410 which is flush against the lower surface of the arm 406. Further, the L-member 408 has a downwardly projecting second arm 412. On the inner surface or hidden surface of the second arm 412 there is an abrasive pad 414. The abrasive pad 414 may be rubber, sand paper or a roughened machine surface. A bolt 416 attaches the L-member 408 to the upper movable positioning arm 406. There is a nut 418 screwed onto the bolt 416 for definitely positioning the L-member 408 on the arm 406.

It is seen that there are set screws connecting with the housing 386 of the screw 390 and also for the upper movable positioning arm 406. The set screws definitely position the arm 406 with respect to the housing 386. The set screws are assigned number 420.

By rotating the screw 390 in one direction the positioning arm 406 can be moved away from the rear frame member 376 and by rotating the screw 390 in the other direction the positioning arm 406 can be retracted toward the rear frame member 376.

In FIG. 20 it is seen that the precast panel 340 has an upper, substantially, flat surface 424.

The screw 328 can be rotated so as to raise the abrasive ledge 320 away from the upwardly directed guide 306. Then, the frame 70 can be moved so that the guide 306 is positioned in the recess 352. The precast panel will rest, to a degree, on the outwardly directed ledge 302. Then, the arm 306 can be moved forwardly and away from the rear frame member 376. The screw 328 can be rotated so as to lower the abrasive ledge 320 against the surface 358. The ledge 302, the guide 306 and the abrasive ledge 320 position the lower part of the panel 340. In time, the upper surface, which is substantially a flat surface 424 will be close to or bear against the lower surface of the arm 406. The screw 390 can be rotated so as to move the abrasive surface 414 against the hidden surface or the inside surface 344 of the precast panel 340. This positions the upper part of the precast panel 340.

To repeat, the lower part of the precast panel 340 is positioned by the outwardly directed ledge 302 and the upwardly directed guide 306 in the recess 352 and the abrasive ledge 320. The upper part of the precast panel 340 is positioned by the arm 406 and the abrasive pad 414.

The operator of the crane can then elevate the frame 70 so as to elevate the precast panel 340.

The reader is to remember that there are at least two upper members 360 of the first positioning means of the precast panel. If desirable, there may be more than two upper members 360 of the first positioning means of the precast panel. From experience I consider that it is necessary to have at least two upper members 360 of the first positioning means for the precast panel.

The foregoing describes the first positioning means and the manner in which the precast panel 340 can be firmly positioned on the frame 70 and then elevated to an opening in a building.

In FIG. 25 there is a front elevational view of the upper member 360 of the first positioning means.

It is seen that in the spaced apart side frame member 378 there are inwardly directed and facing recesses 426. The guide follower plate 384 is positioned in the recesses 426.

Also, there is a pin 428 which connects with the spaced apart central guide 380 and also with the housing 386 for the screw 390.

The upper member 360 can be attached to the upper forward lateral brace 126 by means of a bolt or a pin. In the guide 362 there are bolt holes 430. With the upper member 360 positioned over the guide 362 the holes 432 in the forward downward arm 366 can be aligned with the holes 430 in the guide 362. Then, a bolt 434 or a pin 434 can be positioned in the bolt holes 430 and 432 so as to definitely position the member 360 with respect to the upper forward lateral brace 126.

In FIGS. 23 and 24 there is illustrated a second member 440 which can be used for lifting a precast panel. The second member 440 comprises an upper base 442, a finger 444 behind the upper projecting guides 362 of the upper forward lateral brace 126. Then, an arm 446 depends from the upper base 442 on the exposed surface of the upper forward lateral brace 126. The arm 446 at its lower end bends into an outwardly directed support 448.

It is seen that the base 442, the finger 444 and the arm 446 define a recess 449 which fits over the upward projecting guide 362.

In the finger 444 there is a hole 450. In the arm 446 there is a hole 452. The holes 452 and 450 are aligned. In the guide 362 there is a hole 430. The holes 430, 450 and 452 can be aligned and a bolt 454 placed in these three holes. Then, a nut 456 can be tightened onto the bolt 454 so as to definitely position the second member 440 onto the upward projecting guide 362 and the upper forward lateral brace 126.

The second member 440 can be used for connecting with a precast panel having an opening near the upper part for receiving the upwardly directed support 448. The precast panel is suspended from the outwardly directed support 448 and it is not necessary to have a locking means to lock the precast panel onto the support 448.

Again, it is advisable to have at least two spaced apart second members 440 and in certain instances it may be desirable to have more than two spaced apart second members 440.

In FIGS. 28 and 29 there is illustrated a third support member 460 having an upper base 462. Then, there is a hidden downwardly directed finger 464 and a downwardly directed arm 466. The base 462, the finger 464 and the arm 466 define a recess 468. The recess 468 can be positioned over the guide 362 which is an extension of the upper forward lateral brace 126.

There is an outwardly directed support 470 from the upper part of the arm 466. The support 470 can be welded to the exposed surface or outer surface of the arm 466.

It is seen that there are two spaced apart braces which are attached to the outer surface of the arm 466 and the underneath surface of the support 470. The braces 472 can be welded to 466 and 47.

On the upper surface the support 470 there is an abrasive surface 474 such as rubber, sand paper, a roughened machine part or the like. In the support 470 and the abrasive surface 474 there are holes 476 for receiving bolts or pins.

In the braces 472 and at the junction with the downward surface of the support 470 and also near the exposed surface of the arm 466 there are recesses 478.

There is an upper positioning backrest 480 which can be welded to the upper surface of the upper base 462 above the arm 466. In fact, the backrest 480 and the arm 466 can have a common surface with one being the extension of the other as illustrated in FIG. 28.

On the free surface of the back rest 480 there is an abrasive surface 482 such as rubber, sandpaper or a roughened machine or metal surface.

There are two spaced apart braces 484 connecting with the hidden surface of the back rest 480 and also with the upper surface of the base 462 and the exposed surface of the finger 464.

In the finger 464 there is a hole or passageway 486. In the arm 466 there is a hole or passageway 488 which is aligned with the hole 486. In the guide 362 there is a bolt hole 430. A bolt 490 can be placed in the bolt holes 486, 430 and 488. Then, a nut 492 can be screwed onto the bolt 490 so as to tighten the third support member 460 firmly onto the guide 362 and the frame 70.

In FIGS. 26 and 30 there is illustrated a precast panel 500 having a plurality of horizontal edges 502 and 504. Also, the precast panel 500 has horizontal recesses 506 and 508.

In the precast panel 500 there is a window opening 510.

It is assumed that the precast panel 500 is of a generally rectangular configuration and also that the window opening 510 is of a generally rectangular configuration. The third support member 460 on the guide 362 can be run through the window opening 510 so that the abrasive surface 482 is in contact with the horizontal ledges 502. Also, there is positioned on the support 470 an angle 512 having an upright ledge 514 and a horizontal leg 516.

In the horizontal leg 516 there is a hole or the passageway 518. The hole or the passageway 518 can be aligned with the appropriate hole 476 of the support 470. Then, a bolt 520 can be passed through the holes 518 and 476. A nut 522 can be screwed onto the bolt 520. This definitely positions the angle 512 on the support 470 and also with respect to the hidden surface of the precast panel 500. It is seen that a precast panel 500 is positioned between the abrasive surface 482 and the upright leg 514 and the angle 512. The precast panel 500 can be elevated by the frame 70 so as to be at the proper elevation and then the frame 70 can be moved in toward the openings of the building for receiving the precast panel 500. Since the support 470 is supporting the precast panel at its lower part and there is the angle 512 as a positioning means it is not necessary to have an upper positioning means such as upper member 360. The support member 460 is sufficient by itself.

In FIG. 31 there is illustrated an extension 538 which can be positioned on the outwardly directed support 448 of the second member 440 or can be positioned on the outwardly directed support 470 of the third support member 460. In 448 there are bolt holes 476 and in the outwardly directed support 470 there are bolt holes 476.

The extension 538 can be a U-channel 540 having a base 542, and upper leg 544 and a lower leg 546.

In the lower leg 546 there are bolt holes 548. A bolt 550 can be positioned in the bolt holes 548 and also the bolt holes 476. A nut 552 can be positioned on the bolt so as to firmly attach the extension 538 to the outwardly directed support 448 of the second member 440 or to firmly attach the extension 538 to the outwardly directed support 470 of the third support member 460.

In the upper leg 544 there are bolt holes 554. A bolt 536 can be positioned in the bolt holes 518 of the angle 512 and also in the bolt holes 554. Then a nut 558 can be screwed unto the threaded end of the bolt 556 to definitely position two spaced apart angles 512 as illustrated in FIG. 31.

The precast panel 530 has a series of openings 532. There are horizontal steel bars 534. There are a plurality of horizontal spaced apart steel bars 534. The steel bars may have a thickness of about $1\frac{1}{2}$ inches and a width of about 4 inches.

The precast panel 530 has a forward lower edge 537.

The second support member 440 or the third support member 460 can be positioned on the apparatus 70, as previously explained, and then the extension 538 can be positioned on the second support member 440 or the third support member 470. The extension 538 can be moved so as to be positioned underneath and inwardly of a steel bar 534. Then the angle 512 can be attached to the extension 538 with an angle 512 on each side of the steel bar 534. The upper member 360 can be placed in operating position with respect to the upper edge of the precast panel 530 so as to definitely position the precast panel 530. The apparatus 70 can be elevated so that the extension 538 and the second member 440 or the third member 470 lift the precast panel 530 and also position the lower part of the precast panel 530. The upper member 360 positions the upper part of the precast panel. The precast panel can be elevated to the suitable opening and the apparatus 70 maneuvered so as to place the precast panel 530 in the suitable opening in the building under construction.

In FIGS. 32, 33, 34, and 35, there is illustrated a fourth way for lifting a precast concrete panel 570. In this particular panel, the panels were flat with no feature strips. Therefore, the clamps could not be used for attaching to the panels and lifting the panels with the frame 70. A "Burke Flatfoot" anchor was cast into these panels and a support frame was made that attached the "Burke Rapid Lift" clutches to the lower lift bar of the frame 70. The clutches were then inserted into the flatfoot anchor and the retractor 360 or upper member 360 was used as illustrated in FIGS. 21 and 22 and illustrated in the upper part of FIG. 20 and also as described for FIGS. 21 and 22 and the upper part of FIG. 20. In other words, the Burke Flatfoot anchor was used for positioning the lower part of the precast concrete panel and the retractor 360 or upper member 360 was used for positioning the upper part of the precast concrete panel 570. In this manner the precast concrete panel 570 was firmly positioned with respect to the frame 70.

In the panel 570, there is positioned in the concrete a flatfoot anchor 572 comprising a flat bar 574. There is a hole 576 in the exposed part of the flat bar 574. There is a recess 578 in the panel 570 and which recess exposes the end of the flat bar 574 having a hole 576.

On the front lower part of the frame 70 there is a lateral brace 76 or a lateral member 76. Then, there is an upwardly directed finger or guide 282. The lift clutch comprises a back plate 580 which bears against and is flush against the lateral member 76. On the upper part of the back plate 580 there is an upper arm 582 which is directed towards the frame 70 and overlies the guide 282. On the inner end of the upper arm 582 there is a downwardly directed finger 584. The upper part of the back plate 580, the upper arm 582 and the downwardly directed finger 584 define a recess 585. The upwardly directed guide 282 is positioned in the recess 585.

In the finger 584 there is a passageway 586. In the upper part of the back plate 580 there is a passageway 588. In the guide 282 there are a number of passageways 590. The passageways 86, 588 and one of the passageways 590 can be aligned. Then, a bolt 592 can be positioned in these three passageways and secured in these three passageways by nut 594 on the end of the bolt.

In FIG. 35 it is seen that there are two spaced apart lugs 596 and 598 on the upper part of the front face of the back plate 580. In these spaced apart lugs 596 and 598 there are aligned passageways 600.

Also in the front face of the back plate 580 there is welded or positioned two spaced apart forwardly projecting plates 602. Actually, in FIG. 35, it is seen that there are two sets of these, one on each side of adjacent lugs 596 and 598. On the forward edge of the spaced apart plate 602 there is positioned a forward plate 604. On the exposed surface of the plate 604 there is an abrasive surface 607 which may be rubber or sand paper or a roughened machine surface.

There is a clevis 608 having a U-base 610, first leg 612, and a second leg 614. In the end part of the legs 612 and 614 there are threaded passageways 616. A bolt 618 can be screwed into the threaded passageway 616 in the legs 612 and 614.

A pin 619 can be in the passageway 600 of the two spaced apart lugs 596 and 598. The pin 619 can project through the recess defined by the two legs 612 and 614. The clevis 608 can rotate around the pin 619.

There is a connecting plate 620 having a large end 622 and a small end 624.

In the large end 622 there is a passageway 626.

There is a clutch member 628 comprising a housing 630. The housing comprises two spaced apart sides 632 and 634. There is a curved half shell 636 which connects with the two spaced apart sides 632 and 634, see FIG. 33. This leaves the end of the housing 630, near the small end 624, open.

In FIG. 32 it is seen that there is a radial slot 638 directed toward the precast concrete panel 570 and the flat bar 574. Also, in FIG. 32 it is seen that there is a central slot 640.

In the small end 624 there is a cut out 642. The small end 624 of the connecting plate 622 in conjunction with the cut out 642 defines a curved arm 644. The curved arm 644 is in the central slot 640. The housing 630 can rotate around the curved arm 644.

In FIG. 34 it is seen that there is a rotatable locking member 646 comprising a base 648. The base is directed into a short stubby curved finger 650 having a passageway 652 for receiving the curved arm 644 of the connecting plate 620. Also, the base 648 is also connected with curved finger 654 which can rotate into the hole 576 of the flat bar 574 of the "Flatfoot Anchor" 572.

The rotatable locking member 646 comprises an arm 656. On the free end of the arm 656 there is a hole 658. A keeper 660 passes through the hole 658 and also to the connecting plate 620. Actually, there is a cut out 662 in the large end 622 of the connecting plate 620. The keeper 660 can be a piece of wire which passes through the hole 658 and also through the cut out 662 and that part of the connecting plate 620 surrounding the cut out 662. In this manner the rotatable locking member 646 is precluded from moving any great distance away from the connecting plate 620.

The precast concrete panel 570, prior to being positioned in the building under construction, is on a truck or on the ground. The frame 70 can be moved toward the panel 570 and with the connecting plate 620 substantially horizontal. In FIG. 32 it is seen that the frame 70 and the connecting plate 620 are being moved toward the panel 570 so that the radial slot 638 fits over the exposed flat bar 574 and the hole 576. Then, the frame 70 can be elevated slightly and the connecting plate 620 rotates downwardly toward the frame 70. Withthe rotation of the connecting plate downwardly, the curved finger 654 moves through the hole 576 so as to lock together the clutch 628 and the precast panel 570. The retractor 360 or the upper member 360 is positioned on the upper part of the panel 570 so as to definitely position the panel 570 with respect to the frame 70. It is advisable that there be at least two flat bars 574 with holes 576 and at least two clutches 628. This definitely positions the lower part of the panel 570 with respect to the frame 70. Also, it is advisable that there be two upper members 360 or two upper retractors 360 to definitely position the upper part of the panel 570.

With the panel 570 definitely positioned with respect to the frame 70 the frame 70 can be elevated to the desired height so that the panel 570 can be positioned in the opening 58 in the building under construction. With the panel 570 definitely positioned in the opening 58 in the building under construction the frame 70 can be lowered so that the connecting plate 620 is substantially horizontal. With the frame 70 lowered and the connecting plate 620 substantially horizontal, the curved finger 654 is no longer in the hole 576. The frame 70 can be moved away from the panel 570.

In this manner the "Burke Flatfoot" can be used to position part of a precast panel 570 so as to lift the panel to the desired opening in the building under construction.

In FIGS. 36, 37 and 38, there is illustrated a unitary forklift 670.

The forklift, 670 comprises a back plate 672 and two spaced-apart outwardly extending legs 674. The legs 674 are at a substantially right angle to the back plate 672. The back plate 672 extends upwardly into two spaced apart upright supports 676. Then, each of the upright supports 676 bends at an approximate right angle and extends away from the back plate 672 in an upper cross member 678. The upper cross member then bends downwardly into a depending finger 680. In the upright support 676 and the depending finger 680 are bolt holes 682.

The upright support 676, the upper cross member 678 and the depending finger 680 define a recess 683. The unitary forklift 670 is positioned over the upper guide 362 on the forward angle brace 110, as, previously, stated. There is a first upright brace 106 positioned on the appropriate longitudinal frame member 72 or 74. The upper part of the brace 106 connects with a gusset 136. The gusset 136 also connects with the forward angle brace 110. Further, there is a diagonal brace 107 running from approximately the mid part of the upright brace 106 to the forward part of the forward angle brace 110.

In the guide 362 are holes 430. The bolt holes 682 can be aligned with the appropriate holes 430 and a bolt 684 positioned in the bolt holes. A nut 686 can be positioned in the bolt 684 to definitely position the unitary forklift on the guide 362 and the frame 70. It is noted that the lower part of the back plate 672 rests against the lateral channel 76 of the frame 70.

In FIG. 36 there is illustrated items positioned on the leg 674. These items, by way of illustration, are a box 690, a pipe 692 and steel bars 694. Then, a strap 696 can connect with the outer part of the legs 674 and the back plate 672 to strap down the items on the leg 674. In this manner with the elevation of the apparatus 70 upwardly and also moving the apparatus suddenly forwardly and backwardly, and also sidewardly, the items on the legs 674 will be definitely positioned. The strap 696 can be attached to the outer part of the leg 674 by a tie-down 697 and can be attached to the back plate 672 by a catch 698.

The unitary forklift 670 and the apparatus 70 are a good combination for moving material either from a low level to a high level or from a high level to a low level. In the construction of a building the material can be lifted from the ground upwardly and the apparatus 70 and the forklift 670 with the material on it can be directed inwardly into an opening in the building. Then, after the building has been completed and it is necessary to remove some equipment from the building the equipment can be loaded onto the forklift 670 and the apparatus 70 lowered to ground level or other appropriate level for removal of the equipment on the legs 674.

In FIGS. 39, 40 and 41 there is illustrated another form of a forklift. The forklift members can be the same as the second member 440 as described and illustrated in FIGS. 23 and 24. Therefore, the reader is referred to the description of the second member 440 as stated with respect to FIGS. 23 and 24.

There is a back rest 700 comprising a plate 702. In the plate 702 are at least two spaced apart holes 704. In the upper guide 362 there are spaced apart holes 430. The holes 704 can be aligned with the holes 430 and a bolt 706 positioned in these holes and then a nut 708 positioned on the bolt 706.

The outwardly directing support or legs 448 can be extended to be used as a forklift.

The back rest 700 in FIGS. 39–41 and the back plate 672 of FIGS. 36–38 is of value as there is an opening between the guide 282 and the upward forward lateral brace 126. Therefore, it is necessary to keep items carried on the legs of the forklift from falling backwardly through the openings.

There may be positioned on the legs 448 and the plate 702 a strap 696 and a tie-down 697 on the legs 448 and a catch 698 on the plate 702.

In FIG. 42 there is a schematic illustration of the use of the apparatus. There is positioned on the earth or ground 710 a building 712 under construction.

In the building 712 there are openings 714. There is illustrated a worker 716 positioned in one of the openings. The worker in the right hand has a radio transmitter-receiver 718 or a "walkie talkie". In the left hand the worker has a control panel 720. The control panel 720 connects with the frame by an electrical cable 721.

There is positioned on top of the building under construction a crane 722. There is a pedestal 724 on top of the building 712. On top of the pedestal is a rotatable crane arm 726.

On the crane 722 there is a crane operator 728. In his right hand he has a radio transmitter-receiver 730 know as a "walkie talkie".

The apparatus 70 is suspended from the rotatable crane arm 726 by means of the cable 151. By operating the cable 151 the apparatus 70 can be elevated or lowered. Also, by means of commonly used apparatus on the rotatable crane arm 126 the apparatus 70 can be moved toward the opening 714 or away from the opening 714.

The worker 716 by means of a control panel 720 can control the horizontal position of the apparatus 70 so that the apparatus 70 can hoist the load into the opening 714.

The information in regard to the elevation of the apparatus 70 can be conveyed from the worker 716 to the crane operator 728 by means of the "walkie talkie" 718 and 730. Also, the movement of the apparatus 70 toward the opening 714 away from the opening 714 can be controlled by the worker 716 and the crane operator 728 and the "walkie talkies" 718 and 730.

In FIG. 42 there is illustrated the unitary forklift 670 for lifting items into the opening 714. It is to be understood that the apparatus 70 can be used for lifting other items such as a precast panel 340 as previously described with respect to FIGS. 17, 18, 19, 20, 21 and 22. Also, the apparatus 70 can be used for lifting a precast panel 530 as previously described with respect to FIGS. 27 and 31. Further, the apparatus 70 can be used for lifting the precast panel 500 as previously described with respect to FIGS. 25, 26, 28, 29 and 30. In addition, the apparatus 70 can be used for positioning the precast panel 570 as illustrated and described with respect to FIGS. 32, 33, 34 and 35.

The apparatus 70 is not restricted to a forklift 670. The apparatus 70 is primarily designed to lift precast panels to an appropriate height and to position the precast concrete panels in an appropriate opening in a building under construction.

In FIG. 42 there is also seen another crane 732, in phantom. The crane 732 has a base 734 which rests on the ground or the earth 710. There is positioned on the base 734 a pedestal support 736. On top of the support 736 there is a rotatable crane arm 738. The crane arm has a depending cable 151 for varying the elevation of the apparatus 70 and also for moving the apparatus 70 in a circle of 360°, if necessary and for moving the apparatus 70 with respect to the pedestal 736.

In certain instances it is propitious to have a crane 732 which rests on the ground next to the building 712 under construction In other instances it is advantageous to have a crane 722 which is on top of the building.

In the construction of some buildings there may be two or three cranes on top of the building and two or three cranes on the ground for expediting the construction of the building.

The crane 732 functions in the same manner as the crane 722 for lifting precast panels and supplies to the appropriate opening 714 in the building 712 under construction. Therefore, the description of the crane 722 will not be repeated with respect to the crane 732.

On the apparatus 70 there is an electrical box 749. The control panel 720 connects with the electrical box 749 by means of a cable 721.

There is positioned on the apparatus 70 a combination of an internal combustion engine and a generator. Also, there is a battery 98 which connects with the internal combustion engine. The internal combustion engine is in a driving relationship to the generator. The generator connects with the first wire 752 and a second wire 754.

There is an electric motor 184 which connects with the first wire 752 by means of wire 756. The motor 184 connects with a switch 760 by means of wire 758. The switch 760 connects with the second wire 754 by means of a wire 762. The electric motor 184 connects with the gear box 185 which drives the drum 186.

There is the electric motor 264 which connects with wire 753 by means of wire 764. The motor 264 connects with a switch 768 by means of a wire 766. The switch 768 connects by means of wire 770 with the second wire 754. The motor 264 is in operative relationship to the gear box 266.

There is a motor 210 which connects by wire 772 with the first wire 752. The motor 210 by means of wire 774 connects with a switch 776 which in turn by means of wire 778 connects with the second wire 754. The motor 210 is in operative relationship with the gear box 214.

There is a motor 330 which connects by means of wire 780 with the first wire 752. The motor 330 by means of wire 782 connects with the switch 784 which connects by means of wire 786 with a second wire 754. The motor 330 connects with a gear head 331.

There is a motor 394 which by means of wire 788 connects with a switch 790. The switch 790 connects with the second wire 754. The motor 394 connects with the wire 752 and is in an operative relationship with the gear head 396.

The control panel 720 comprises of switches 760, 768, 776, 786 and 790. As is recalled, the control panel 720 by means of cable 721 connects with the electrical box 749 and also connects with the motors 182, 264, 210, 330 and 394.

A control panel 720 can be carried on the apparatus 70. When the apparatus 70 and the load is being lifted the control panel 720 is on said apparatus. Then, when the apparatus 70 and the load are near the opening 714 in the building 712 the workman 716 can reach out with a hooking means and pull the panel 72 toward him so that he has the panel in his possession. By operating the various switches, it is possible for the workman 716 to make the apparatus 70 and its load both longitudinally horizontal and laterally horizontal. The crane operator 728 can move the apparatus 70 and its load toward the opening 714. In placing precast panels in the opening 714 there is often only a two inch clearance on the longitudinal length to the panel and also the lateral length of the panel with respect to the opening. It is necessary for the workman 716 to make the apparatus 70 and the precast panel horizontal so that the precast panel can be moved into the opening 714.

The workman 716 by means of a "walkie talkie" can direct the crane operator 728 with respect to moving the panel horizontally with respect to the opening so that the panel will get into the opening. Then, the workman can direct the crane operator to move the apparatus 70 and the panel into the opening. The panel can be positioned in place. For example, one way of positioning the panel in place is to weld the exposed metal parts of the panel to the metal parts surrounding the opening 714. In this manner the precast panel is welded into position. After the precast panel has been welded into position the workman 716 can place the control panel back on the apparatus 70 or else unplug the control panel from the apparatus 70 and the crane operator 728 can move the apparatus 70 away from the opening 714 and away from the building.

Figure 14:
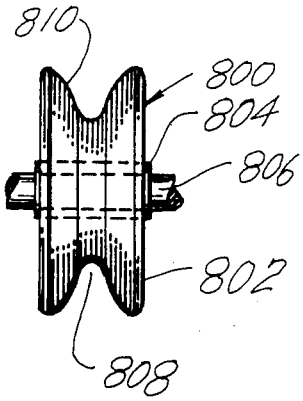
FIG. 14 is an end view of a sheave which can be used with a levelling system for the frame of the apparatus.

In FIG. 14 there is illustrated a pulley 800 which is like the pulleys 200 and 202. The pulley 800 has a flat outer side 802. There is a central passageway. A bearing 804 is positioned in the central passageway. There is a shaft 806 and a bearing 804.

The pulley 800 has a inner groove and then a curved side 810 leading from the inner groove to the flat outer side 802. The curved side 810 is a reverse curve.

The pulley 800 allows some play in a cable positioned in the inner groove 808. This is because of the reverse curved side 810.

Again, the pulley 800 can be used like the pulleys 200 and 202.

RESUME'

From the foregoing it is seen that the apparatus 70 is useful for a structure under construction. The apparatus 70 can lift objects to a desired height and to a desired location in a structure under construction. For example, the apparatus 70 can lift a precasr concrete panel which may weigh in the range of 10,000 pounds to 15,000 pounds to a desired height and to a desired location in a building under construction.

A building under construction has openings for receiving a precast concrete panel. The opening has about a 1 inch tolerance at the top and at the bottom for receiving the precast concrete panel. Also, the opening has about a 1 inch tolerance on each side for receiving the precast concrete panel. Therefore, the panel must be carefully positioned and centered with respect to the opening. The panel must be horizontally and vertically aligned with respect to the opening and then the panel must be moved into the opening to the desired depth in the opening or to the desired position in the opening. The apparatus of this invention has the ability to center the panel both horizontally and vertically with respect to the opening and has the ability to move the precast concrete panel to the desired depth or desired position in the opening.

In certain instances the apparatus is used as a flying forklift device for moving supplies to the desired height and desired opening in a building under construction. The opening in the building under construction is larger than the supplies and therefore the apparatus need not be as carefully centered, both horizontally and vertically, when moving supplies to the desired opening in the building under construction as compared to moving a precast concrete panel to the opening in a building under construction. The apparatus can be elevated to the desired height with the forklift attachment and with the supplies on the forklift and move into the opening in the building under construction. Then the supplies can be taken from the forklift and placed in the building. It is possible to move supplies in an elevator to the desired height in a building. However, the elevator is fixed with respect to the opening and therefore the supplies after reaching the desired height may be moved manually to the desired location. This is expensive and time consuming. With the apparatus of this invention the supplies can be moved to the desired opening and used in the construction of the building near the desired opening. Also, I consider that it is easier to move supplies on this apparatus as compared with moving the supplies in an elevator.

In addition to using the apparatus 70 for a building under construction it is possible to use the apparatus 70 for a bridge under construction as the forklift attachment is a convenient way to move construction supplies. Likewise, the apparatus 70 can be used for a dam under construction; towers for carrying high voltage electrical power lines under construction; and, towers for transmitting and receiving electromatic magnetic waves such as radio and television signals and also microwave signals.

I invented this apparatus to position precast concrete panels in a recessed opening in a building under construction. The apparatus was invented to make it easier and quicker to place the precast concrete panels in a recessed opening. Then, this invention evolved into a flying forklift device for lifting supplies to a desired height and to a desired opening in a building under construction.

The apparatus 70 comprises a crane having two spaced apart outside longitudinal members 72 and 74. There are suitable lateral bracing members between the two outside longitudinal members.

A crane mounted on a building or a crane mounted on the ground or a crane mounted on a truck or trailer is used for lifting the apparatus. A cable connects the crane with the apparatus. The suspension means for the apparatus is positioned approximately midway of the length of the longitudinal members 72 and 74 and also midway between the length of the lateral members. A link 154 connects with the pulley which is positioned in the cable from the crane. The link is positioned above and inwardly of the forward and fastening end of the apparatus 70. Cables 158 and 162 connect with the link 154 and the frame of the apparatus, inwardly of the forward and fastening end of the apparatus. The cables 158 and 162 may connect with the frame of the apparatus approximately 4 or 5 feet inwardly of the forward and fastening end of the apparatus. A cable 168 connects with each longitudinal member about midway or midlength. Then, the suspension means allows the forward and fastening end to project inwardly into the recessed opening of the building without the suspension cable 151 touching the building. The cable 151 connects with the crane.

There is a lengthwise or longitudinal levelling counterweight 240 moving longitudinally on the frame of the apparatus so as to position the longitudinal members of the apparatus in a horizontal position. The longitudinal members 72 and 74 of the apparatus can be finally levelled by varying the length of the cable 168 by means of cable 188 and drum 186. It is possible to have the apparatus 70 substantially horizontal by means of varying the length of the cable 168.

The lateral or sideway levelling of the apparatus is accomplished by adjusting the length of the cable 158 and the cable 162.

The change in elevation of the height of the apparatus 70 may be referred to as the Y-axis.

The change in the lateral adjustment or the lateral horizontal adjustment of the apparatus 70 may be refered to as the X-axis. The change in the adjustment or the change in the longitudinal horizontal position of the apparatus 70 may be referred to as the Z-axis. To position a precast concrete panel in an opening in a building under construction it is almost mandatory that the X-axis of the apparatus be horizontal and that the Z-axis of the apparatus be horizontal. Also, the movement of the apparatus along the Z-axis into the opening of the building is necessary to position the precast panel in the opening in the building.

The precast panel may be of various heights such as 4 feet or 5 feet or 6 feet. The length of the precast panel can be 10 feet or 15 feet or other appropriate lengths. The thickness of the precast panel can vary from 4 inches to 12 inches or maybe 16 inches or 20 inches. The weight of the precast panel can vary from 5 tons to 15 tons.

The precast concrete panel 340 has an outwardly directed ledge 348. There is a recess 352 in the lower part. The apparatus 70 has a ledge 302 with a guide 306 which fits in the recess 352 of the panel 340. Also, the apparatus 70 has a guide 312 which bears down of the ledge 348. The ledge 302 and guide 312 positions the lower part of the precast panel 340. There is positioned on the apparatus 70 an upper member 360 which positions the upper part of the panel 340. In this manner the lower part and the upper part of the precast panel 340 are positioned and the apparatus 70 and the attached panel can be elevated and moved to the desired opening in the building under construction.

There is a panel 530 which has horizontal lateral bars 532. An extension 538 on the second member 440 or the third member 460 can move underneath a metal bar 532 and the upper member 360 can operatively connect with the upper part of the panel 530 so that the panel is definitely positioned on the apparatus 70. Then the apparatus 70 and the panel 530 can be elevated to the desired height and opening in the building under construction.

There is a panel 500 having an opening 510. The third support member 460 can be positioned to lift the panel 510 or else an extension 538 can be positioned on the third support member 460 to assist in lifting the panel 510.

There is a panel 570 having an iron bar with an opening in the iron bar. The iron bar is formed into the precast panel 570. A "Burk rapid lift" clutch is used to attach a curved finger 654 to the iron bar 574. The curved finger 664 projects through the opening 576 in the iron bar 574. Then, the apparatus 70 and the panel 570 can be lifted and moved to the desired opening in the building under construction.

There are forklifts which can be attached to the apparatus 70 for lifting various supplies and building material. There is a unitary forklift 670 which can be positioned on the apparatus 70 for lifting supplies. Then, there is a second type of forklift which comprises the second member 440 and a back plate 700 to prevent material from falling backwardly and out of the apparatus 70. The second member 440 can be used for lifting precast concrete panels and can also be used as a forklift.

The apparatus 70 is self-contained. It has a combination internal combustion engine and generator 94 and a battery 98. These are positioned on the apparatus 70. Then, there is an electrical control box 794 which receives it's electrical energy from the combination of engine and generator 94. A cable 721 connects with the electrical control box and also with the control panel 720. The cable is sufficiently long to allow the control panel 720 to be positioned inside of a building under construction while the apparatus 70 is outside of the building. The operator can use the control panel 720 for levelling the apparatus 70 around the X-axis and also for levelling the apparatus 70 along the Z-axis. The person with the control panel 720 by means of a walkie talkie can communicate with the operator of the crane. The operator of the crane can move the apparatus 70 and the precast panel on the apparatus 70 towards the opening. When the precast panel is positioned as desired in the opening of the building a person can weld the steel casement around the precast panel to the steel casement inside of the opening. This positions the precast panel definitely in the opening in the building. Also it may be useful to have nuts and bolts for positioning the precast panel in the opening in the building.

As is seen from the foregoing the apparatus 70 can be outside of the building and under the control, mainly, of the workmen inside of the building has the electrical control panel in his hands inside of the building and also has the walkie talkie in his hands inside of the building.

I consider that some of the objects and advantages of this invention to be that it is safer to lift and position in a building under construction precast concrete panels by the apparatus 70 than by attaching a cable to the panel and then using rods and pulls and the like to try and position the panels.

Further, I consider that it is easier to position a precast concrete panel in an opening in a building by the apparatus 70 than by previously used methods and means.

Also, I consider that it is less time consuming to position a precast panel in an opening in a building by the apparatus 70 than by previsouly used means and methods.

A further advantage is that I consider it to be less expensive to use the apparatus 70 in positioning a precast panel in an opening in a building because more panels can be positioned in a unit of time than with prior methods and means.

In addition, I consider that the apparatus 70 has advantage as it can be used as a flying forklift device for elevating materials and supplies to a desired location in a structure under construction and therefore it is easier to use the apparatus 70 as a flying forklift device than previosuly used means.

I consider the apparatus 70 as used as a flying forklift device is less time consuming than previously used means and methods for transporting materials and supplies to a desired location in a structure under construction.

Further, I consider that it is less expensive to use the apparatus 70 as a flying forklift for transferring materials and supplies to a desired location in a structure under construction as compared with previously known means and methods.

I consider the invention to be new, useful and unobvious.

I consider the invention to be new as I have never seen a device similar to the apparatus 70. I have been in construction for over twenty years and have been associated with the erection of steel buildings and steel structures for over twenty years. In that period of time I have never seen a design like the apparatus 70.

I consider the invention to be useful as it is of great assistance in the construction of a structure such as a building, a dam and a tower. The elevation and positioning of a precast concrete panel in a building is a difficult job if a crane and a cable by itself is used. With the apparatus 70 the positioning of a precast panel in a building under construction can be readily accomplished. I have noted that there is less time involved in using the apparatus 70 for positioning a precast concrete panel in a building as compared to using a crane and a cable by themselves for positioning a precast concrete panel in a building.

I consider the invention and apparatus 70 to be unobvious as I have never seen such a device even though I have worked in the erection of steel for over twenty years. I have not seen a device similar to the subject invention of this patent application.

In preparing this patent application a patent search was not made.

From the foregoing and having presented my invention what I claim is:

1. An apparatus for lifting an object, said apparatus comprising:

a. a frame;
b. said frame having a head-in lateral brace;
c. said head-in lateral brace having an upper edge defining a guide means identified as a first guide means;
d. an outwardly directed support for receiving and for positioning an object;
e. said outwardly directed support having a first recess means for fitting over and for receiving said first guide means;
f. said outwardly directed support being supported by said head-in lateral brace of said first guide means;
g. said frame comprising a plurality of supporting braces;
h. a forward lateral brace operatively connecting with said supporting braces;
i. said forward lateral brace being spaced apart from said head-in lateral brace;
j. said forward lateral brace having an upper edge defining a guide means identified as a second guide means;
k. said forward lateral brace having means for receiving and for supporting said outwardly directed support;
l. an arm depending from said recess means;
m. said outwardly directed support being on the lower part of said arm;
n. said frame having two spaced apart longitudinal members;
o. said two spaced apart longitudinal members operatively connecting with said head-in lateral brace;
p. a levelling means identified as a first levelling means for varying the position of and for levelling said head-in lateral brace;
q. a levelling means identified as a second levelling means for varying the position of and for levelling said two spaced-apart longitudinal members with respect to the horizontal;
r. said first levelling means comprising a suspension means identified as a first suspension means for said frame;
s. said first suspension means comprising two spaced apart guide means identified as a right guide means and a left guide means positioned laterally on said frame;
t. said first suspension means comprising a cable means identified as a first cable means associated with said guide means;

u. said first suspension means having two ends identified as a first end and a second end;

v. said first end being associated with said first cable means near said right guide means and said second end being associated with said first cable means near said left guide means;

w. a movable plate connecting with said first cable means to vary the length of said first cable means with respect to said right guide means and said first end and to vary the length of said first cable means with respect to said left guide means and said second end to adjust the lateral axis of said frame with respect to the horizontal; and, x. said second levelling means comprising a movable counterweight positioned on said frame and which counterweight can move towards said head-in lateral brace and can move away from said head-in lateral brace to adjust the position of said longitudinal member with respect to the horizontal.

2. An apparatus according to claim 1 and comprising:

a. two of said outwardly directed supports positioned on said first guide means;

b. said second levelling means comprising a suspension means identified as a second suspension means for said frame;

c. said two spaced apart longitudinal members identified as a right longitudinal member and a left longitudinal member;

d. said second suspension means comprising a lug identified as a first connecting means operatively connecting with said right longitudinal member and a lug identified as a second connecting means operatively connecting with said left longitudinal member;

e. a cable means identified as a second cable means having a first end identified as a second cable first end and having a second end identified as a second cable second end;

f. said second cable first end connecting with said first connecting means;

g. said second cable means being capable of allowing said second cable means to move with respect to said second connecting means;

h. a suspending means identified as a third suspension means positioned above said frame and being capable of receiving said second cable means and allowing said second cable means to move with respect to said third suspension means; and, i. a length adjusting means operatively connecting with said second cable second end of said second cable means to adjust the position of said two spaced apart longitudinal members with respect to the horizontal.

3. An apparatus according to claim 2 and comprising:

a. said third suspension means operatively connecting with said first suspension means and said second suspension means; and, b. said third suspension means being positioned with respect to said frame so that said head-in lateral brace is forward of said third suspension means.

4. An apparatus for lifting and object, said apparatus comprising:

a. a frame;

b. said frame having a head-in lateral brace;

c. said head-in lateral brace having an upper edge defining a guide means identified as a first guide means;

d. an outwardly directed support for receiving and for positioning an object;

e. said outwardly directed support having a first recess means for fitting over and for receiving said first guide means;

f. said outwardly directed support being supported by said head-in lateral brace and said first guide means;

g. said frame comprising a plurality of supporting braces;

h. a forward lateral brace operatively connecting with said supporting braces;

i. said forward lateral brace being spaced apart from said head-in lateral brace;

j. said forward lateral brace having an upper edge defining a guide means identified as a second guide means;

k. said forward lateral brace having a means for receiving and for supporting said outwardly directed support;

l. said outwardly directed support extending outwardly from said first recess means;

m. a downwardly directed arm operatively connecting with said first recess means;

n. an upper positioning back rest connecting with said first recess means;

o. said frame having two spaced apart longitudinal members;

p. said two spaced apart longitudinal members operatively connecting with said head-in lateral brace;

q. a first levelling means for varying the position of and for levelling said head-in lateral brace;

r. a second levelling means for varying the position of and for levelling said two spaced apart longitudinal members;

s. said first levelling means comprising a first suspension means for said frame;

t. said first suspension means comprising two spaced apart guide means identified as a right guide means and a left guide means positioned laterally on said frame;

u. said first suspension means comprising a cable means identified as a first cable means associated with said guide means;

v. said first suspension means having two ends identified as a first end and a second end;

w. said first end being associated with said first cable means near said right guide means and said second end being associated with said first cable means near said left guide means;

x. a movable plate connecting with said first cable means to vary the length of said first cable means with respect to said right guide means and said first end and to vary the length of said first cable means with respect to said left guide means and said second end to adjust the lateral axis of said frame with respect to the horizontal; and, y. said second levelling means comprising a movable counterweight positioned on said frame and which counterweight can move toward said head-in lateral brace and can move away from said head-in lateral brace to adjust the position of said longitudinal member with respect to the horizontal.

5. An apparatus according to claim 4 and comprising:

a. a brace connecting with said downwardly directed arm and said outwardly directed support to support said outwardly directed support;

b. a brace connecting with said upper positioning back rest and said recess means to support said upper positioning back rest;
c. two of said outwardly directed supports positioned on said first guide means;
d. said second levelling means comprising a second suspension means for said frame;
e. said two spaced apart longitudinal members identified as a right longitudinal member and a left longitudinal member;
f. said second suspension means comprising a lug identified as a first connecting means operatively connecting with said right longitudinal member and a lug identified as a second connected means operatively connecting with said left longitudinal member;
c. a cable means identified as a second cable means having a first end identified as a second cable first end and having a second end identified as a second cable second end;
h. said second cable first end connecting with said first connecting means;
i. said second cable means being capable of allowing said second cable means to move with respect to said second connecting means;
j. a suspending means identified as a third suspension means positioned above said frame and being capable of receiving said second cable means and allowing said second cable means to move with respect to said suspending means; and,
k. a length adjusting means operatively connecting with said second cable second end of said second cable means to adjust the position of said two spaced apart longitudinal members with respect to the horizontal.

6. An apparatus according to claim 5 and comprising:
a. said third suspension means operatively connecting with said first suspension means and said second suspension means; and,
b. said third suspension means being positioned with respect to said frame so that said head-in lateral brace is forward of said third suspension means.

7. A combination of an object and an apparatus for lifting said object, said combination comprising:
a. a frame;
b. said frame having a head-in lateral brace;
c. said head-in lateral brace having an upper edge defining a guide means identified as a first guide means;
d. an outwardly directed support for receiving and for positioning an object;
e. said outwardly directed support having a first recess means for fitting over and for receiving said first guide means;
f. said outwardly directed support being supported by said head-in lateral brace of said first guide means;
g. said frame comprising a plurality of supporting braces;
h. a forward lateral brace operatively connecting with said supporting braces;
i. said forward lateral brace being spaced apart from said head-in lateral brace;
j. said forward lateral brace having an upper edge defining a guide means identified as a second guide means;
k. said forward lateral brace having means for receiving and for supporting said outwardly directed support;
l. said object operatively connecting with said outwardly directed support for said apparatus to be able to lift said object;
m. said outwardly directed support and said frame capable of being separated;
n. a positioning means for definitely positioning said outwardly directed support on said guide means;
o. an arm depending from said recess means;
p. said outwardly directed support being on the lower part of said arm;
q. said frame having two spaced apart longitudinal members;
r. said two spaced apart longitudinal members operatively connecting with said head-in lateral brace;
s. a first levelling means for varying the position of and for levelling said head-in lateral brace;
t. a second levelling means for varying the position of and for levelling said two spaced apart longitudinal members;
u. said object having a cross-member underneath which said outwardly directed support can be positioned to assist said apparatus in the lifting of said object;
v. said first levelling means comprising a suspension means identified as a first suspension means for said frame;
w. said first suspension means comprising two spaced apart guide means identified as a right guide means and a left guide means positioned laterally on the frame;
x. said first suspension means comprising a cable means identified as a first cable means associated with said guide means;
y. said first suspension means having two ends identified as a first end and a second end;
z. said first end being associated with said first cable means near said right guide means and said second end being associated with said first cable means near said left guide means;
aa. a movable plate connecting with said first cable means to vary the length of said first cable means with respect to said right guide means and said first end and to vary the length of said cable means with respect to said left guide means and said second end to adjust the lateral axis of said frame with respect to the horizontal; and,
bb. said second levelling means comprising a movable counterweight positioned on said frame and which counterweight can move toward said head-in lateral brace and can move away from said head-in lateral brace to adjust the position of said longitudinal member with respect to the horizontal.

8. A combination of an object and an apparatus according to claim 7 and comprising:
a. two of said outwardly directed supports positioned on said first guide means;
b. said second levelling means comprising a second suspension means for said frame;
c. said two spaced apart longitudinal members identified as a right longitudinal member and a left longitudinal member;
d. said second suspension means comprising a lug identified as a first connecting means operatively connecting with said right longitudinal member and a lug identified as a second connecting means operatively connecting with said left longitudinal member;

e. a cable means identified as a second cable means having a first end identified as a second cable first end and having a second end identified as a second cable second end;

f. said second cable first end connecting with said first connecting means;

g. said second cable means being capable of allowing said second cable means to move with respect to said second connecting means;

h. a suspending means identified as a third suspension means positioned above said frame and being capable of receiving said second cable means and allowing said second cable means to move with respect to said suspending means;

i. a length adjusting means operatively connecting with said second cable second end of said second cable means to adjust the position of said two spaced apart longtiduinal members;

j. said object being a concrete panel, having an opening; and, k. said cross-member being in said opening.

9. A combination of an object and an apparatus according to claim 8 and comprising:

a. a third suspension means operatively connecting with said first suspension means and said second suspension means; and, b. said third suspension means being positioned with respect to said frame so that said head-in lateral brace is forward of said third suspension means.

10. A combination of an object and an apparatus for lifting said object, said combination comprising:

a. a frame;

b. said frame having a head-in lateral brace;

c. said head-in lateral brace having an upper edge defining a guide means identified as a first guide means;

d. an outwardly directed support for receiving and for positioning an object;

e. said outwardly directed support having a first recess means for fitting over and for receiving said first guide means;

f. said outwardly directed support being supported by said head-in lateral brace of said first guide means;

g. said frame comprising a plurality of supporting braces;

h. a forward lateral brace operatively connecting with said supporting braces;

i. said forward lateral brace being spaced apart from said head-in lateral brace;

j. said forward lateral brace having an upper edge defining a guide means identified as a second guide means;

k. said forward lateral brace having means for receiving and for supporting said outwardly directed support;

l. said object operatively connecting with said outwardly directed support for said apparatus to be able to lift said object;

m. said outwardly directed supports extending outwardly from said first recess means;

n. a downwardly directed arm operatively connecting with said first recess means;

o. an upper positioning back rest connecting with said first recess means;

p. said frame having two spaced apart longitudinal members;

q. said two spaced apart longitudinal members operatively connecting with said head-in lateral brace;

r. a first levelling means for varying the position of and for levelling said head-in lateral brace;

s. a second levelling means for varying the position of and for levelling said two spaced-apart longitudinal members;

t. said object having an opening;

u. said opening defining an upper ledge underneath which said outwardly directed support can be positioned for said apparatus to be able to fit said object;

v. said first levelling means comprising a first suspension means for said frame;

w. said first suspension means comprising two spaced apart guide means identified as a right guide means and a left guide means positioned laterally on said frame;

x. said first suspension means comprising a cable means identified as a first cable means associated with said guide means;

y. said first suspension means having two ends identified as a first end and a second end;

z. said first end being associated with said first cable means near said right guide means and said second end being associated with said first cable means near said left guide means;

aa. a movable plate connecting with said first cable means to vary the length of said first cable means with respect to said right guide means and said first end and to vary the length of said first cable means with respect to said left guide means and said second end to adjust the lateral axis of said frame with respect to the horizontal; and;

bb. said second levelling means comprising a movable counterweight positioned on said frame and which counterweight can move toward said head-in lateral brace and can move away from said head-in lateral brace to adjust the position of said longitudinal member with respect to the horizontal.

11. A combination of an object and an apparatus according to claim 10 and comprising:

a. a brace connecting with said downwardly directed arm and said outwardly directed support to support said outwardly directed support;

b. a brace connecting with said upper positioning back rest and said recess means to support said upper positioning back rest;

c. two of said outwardly directed supports positioned on said first guide means;

d. said second levelling means comprising a suspension means identified as a second suspension means for said frame;

e. said two spaced apart longitudinal members identified as a right longitudinal member and a left longitudinal member;

f. said second suspension means comprising a lug identified as a first connecting means operatively connecting with said right longitudinal member and a lug identified as a second connecting means operatively connecting with said left longitudinal member;

g. a cable means identified as a second cable means having a first end identified as a second cable first end and having a second end identified as a second cable second end;

h. said second cable first end connecting with said first connecting means;

i. said second cable means being capable of allowing said second cable means to move with respect to said second connecting means;

j. a suspending means identified as a third suspension means positioned above said frame and being capable of receiving said second cable means and allowing said second cable means to move with respect to said suspending means; and, k. a length adjusting means operatively connecting with said second cable second end of said second cable means to adjust the position of said two spaced apart longitudinal members with respect to the horizontal.

12. A combination of an object and an apparatus according to claim 11 and comprising a. a third suspension means operatively connecting with said first suspension means and said second suspension means; and, b. said third suspension means being positioned with respect to said frame so that said head-in lateral brace is forward of said third suspension means.

13. An apparatus for lifting an object, said apparatus comprising:

a. a frame;

b. said frame having a first supporting means;

c. a first support;

d. an attaching means for connecting said first support to said supporting means;

e. said supporting means being in a supporting relationship to said first support;

f. said frame comprising at least one longitudinal member and at least one internal member;

g. a levelling means identified as a first levelling means for varying the position of and for levelling said lateral brace;

h. said first levelling means comprising a suspension means identified as a first suspension means for said frame;

i. said first suspension means comprising two spaced apart guide means identified as a right guide means and a left guide means positioned laterally on said frame;

j. said first suspension means comprising a cable means identified as a first cable means associated with said guide means;

k. said first suspension means having two ends identified as a first end and a second end;

l. said first end being associated with said first cable means near said right guide means and said second end being associated with said first cable means near said left guide means;

m. a movable plate connecting with said first cable means to vary the length of said first cable means with respect to said right guide means and said first end and to vary the length of said first cable means with respect to said left guide means and said second end to adjust the lateral axis of said frame with respect to the horizontal;

n. a power means identified as a first power means operatively connecting with said movable plate for moving said movable plate;

o. a levelling means identified as a second levelling means for varying the position of and for levelling said two spaced apart longitudinal members with respect to the horizontal;

p. said second levelling means comprising a suspension means identified as a second suspension means for said frame;

q. said second suspension means comprising a lug identified as a first connecting means operatively connecting said frame on the right and comprising a lug identified as a second connecting means operatively connecting with said frame on the left;

r. a cable means identified as a second cable means having a first end identified as a second cable first end and having a second end identified as a second cable second end;

s. said second cable first end connecting with said first connecting means;

t. said second cable means being capable of allowing said second cable means to move with respect to said second connecting means;

u. a suspending means identified as a third suspension means positioned above said frame and being capable of receiving said second cable means and allowing said second cable means to move with respect to said third suspension means; and, v. a length adjusting means operatively connecting with said second cable second end of said second cable means to adjust the position of said longitudinal member with respect to the horizontal.

14. An apparatus for lifting an object, said apparatus comprising:

a. a frame;

b. said frame having a first supporting means;

c. a first support;

d. an attaching means for connecting said first support to said supporting means;

e. said supporting means being in a supporting relationship to said first support;

f. said frame comprising at least one longitudinal member and at least one internal member;

g. a levelling means identified as a first levelling means for varying the position of and for levelling said lateral brace;

h. said first levelling means comprising a suspension means identified as a first suspension means for said frame;

i. said first suspension means comprising two spaced apart guide means identified as a right guide means and a left guide means positioned laterally on said frame;

j. said first suspension means comprising a cable means identified as a first cable means associated with said guide means;

k. said first suspension means having two ends identified as a first end and a second end;

l. said first end being associated with said first cable means near said right guide means and said second end being associated with said first cable means near said left guide means;

m. a movable plate connecting with said first cable means to vary the length of said first cable means with respect to said right guide means and said first end and to vary the length of said first cable means with respect to said left guide means and said second end to adjust the lateral axis of said frame with respect to the horizontal;

n. a power means identified as a first power means operatively connecting with said movable plate for moving said movable plate;

o. a levelling means identified as a second levelling means for varying the position of and for levelling said two spaced apart longitudinal members with respect to the horizontal;

p. said frame having an end identified as a front end;

q. said second levelling means comprising a movable counterweight which can move toward said front end and away from said front end to adjust the position of said longitudinal member with respect to the horizontal;

r. a power means identified as a second power means operatively connecting with said counterweight for moving said counterweight;

s. said support having an outwardly directed support arm;

t. a levelling means identified as a second levelling means for varying the position of and for levelling said two spaced apart longitudinal members with respect to the horizontal;

u. said second levelling means comprising a suspension means identified as a second suspension means for said frame;

v. said second suspension means comprising a lug identified as a first connecting means operatively connecting said frame on the right and comprising a lug identified as a second connecting means operatively connecting with said frame on the left;

w. a cable means identified as a second cable means having a first end identified as a second cable first end and having a second end identified as a second cable second end;

x. said second cable first end connecting with said first connecting means;

y. said second cable means being capable of allowihg said second cable means to move with respect to said second connecting means;

z. a suspending means identified as a third suspension means positioned above said frame and being capable of receiving said second cable means and allowing said second cable means to move with respect to said third suspension means;

aa. a length adjusting means operatively connecting with said second cable second end of said second cable means to adjust the position of said longitudinal member with respect to the horizontal;

bb. an electrical energy generating means identified as a generator means on said frame;

cc. said first power means comprising an electric motor identified as a first electric motor operatively connecting with said movable plate for moving said movable plate;

dd. said second power means comprising an electric motor identified as a second electric motor operatively connecting with said counterweight for moving said counterweight;

ee. said length adjusting means comprising an electric motor identified as a third electric motor operatively connecting with said second cable end;

ff. said first cable means, said second cable means and said third cable means operatively connecting with said generating means;

gg. a control means operatively connecting with said first cable means, said second cable means and said third cable means to control said electric motors;

hh. part of said control means may be off of and remote from said frame to allow control of said electric motors away from said frame; and, ii. said third suspension means operatively connecting with said first suspension means and said second suspension means.

15. An apparatus for lifting an object, said apparatus comprising:

a. a frame;

b. said frame having a first supporting means;

c. a first support;

d. an attaching means for connecting said first support to said supporting means;

e. said supporting means being in a supporting relationship to said first support;

f. said frame comprising at least one longitudinal member and at least one internal member;

g. a levelling means identified as a first levelling means for varying the position of and for levelling said lateral brace;

h. said first levelling means comprising a suspension means identified as a first suspension means for said frame;

i. said first suspension means comprising two spaced apart guide means identified as a right guide means and a left guide means positioned laterally on said frame;

j. said suspension means comprising a cable means identified as a first cable means associated with said guide means;

k. said first suspension means having two ends identified as a first end and a second end;

l. said first end being associated with said first cable means near said right guide means and said second end being associated with said first cable means near said left guide means;

m. a movable plate connecting with said first cable means to vary the length of said first cable means with respect to said right guide means and said first end and to vary the length of said first cable means with respect to said left guide means and said second end to adjust the lateral axis of said frame with respect to the horizontal;

n. a power means identified as a first power means operatively connecting with said movable plate for moving said movable plate;

o. a levelling means identified as a second levelling means for varying the position of and for levelling said two spaced apart longitudinal members with respect to the horizontal;

p. said frame having an end identified as a front end;

q. said second levelling means comprising a movable counterweight which can move toward said front end and away from said front end to adjust the position of said longitudinal member with respect to the horizontal;

r. a power means identified as a second power means operatively connecting with said counterweight for moving said counterweight;

s. said support having an outwardly directed support arm;

t. a levelling means identified as a second levelling means for varying the position of and for levelling said two spaced apart longitudinal members with respect to the horizontal;

u. said second levelling means comprising a suspension means identified as a second suspension means for said frame;

v. said second suspension means comprising a lug identified as a first connecting means operatively connecting said frame on the right and comprising a lug identified as a second connecting means operatively connecting with said frame on the left;

w. a cable means identified as a second cable means having a first end identified as a second cable first end and having a second end identified as a second cable second end;

x. said second cable first end connecting with said first connecting means;

y. said second cable means being capable of allowing said second cable means to move with respect to said second connecting means;

z. a suspending means identified as a third suspension means positioned above said frame and being capable of receiving said second cable means and allowing said sedond cable means to move with respect to said third suspension means;

aa. a length adjusting means operatively connecting with said second cable second end of said second cable means to adjust the position of said longitudinal member with respect to the horizontal;

bb. an electrical energy generating means identified as a generator means on said frame;

cc. said first power means comprising an electric motor identified as a first electric motor operatively connecting with said movable plate for moving said movable plate;

dd. said second power means comprising an electric motor identified as a second electric motor operatively connecting with said counterweight for moving said counterweight;

ee. said adjusting means comprising an electric motor identified as a third electric motor operatively connecting with said second cable second end;

ff. said first cable means, said second cable means and said third cable means operatively connecting with said generating means;

gg. a control means operatively connecting with said first cable means, said second cable means and said third cable means to control said electric motors;

hh. part of said control means may be off of and remote from said frame to allow control of said electric motors away from said frame;

ii. said third suspension means operatively connecting with said first suspension means and said second suspension means;

jj. two spaced apart said first supports on said first supporting means; and, kk. a back stop associated with said two spaced apart first supports to restrict the movement of an object on said outwardly directed support arms with respect to said frame.

16. An apparatus for lifting an object, said apparatus comprising:

a. a frame;

b. said frame having a first supporting means;

c. a first support;

d. an attaching means for connecting said first support to said supporting means;

e. said supporting means being in a supporting relationship to said first support;

f. said frame comprising at least one longitudinal member and at least one internal member;

g. a levelling means identified as a first levelling means for varying the position of and for levelling said lateral brace;

h. said first levelling means comprising a suspension means identified as a first suspension means for said frame;

i. said first suspension means comprising two spaced apart guide means identified as a right guide means and a left guide means positioned laterally on said frame;

j. said first suspension means comprising a cable means identified as a first cable means associated with said guide means;

k. said first suspension means having two ends identified as a first end and a second end;

l. said first end being associated with said first cable means near said right guide means and said second end being associated with said first cable means near said left guide means;

m. a movable plate connecting with said first cable means to vary the length of said first cable means with respect to said right guide means and said first end and to vary the length of said first cable means with respect to said left guide means and said second end to adjust the lateral axis of said frame with respect to the horizontal;

n. a power means identified as a first power means operatively connecting with said movable plate for moving said movable plate;

o. a levelling means identified as a second levelling means for varying the position of and for levelling said two spaced apart longitudinal members with respect to the horizontal;

p. said frame having an end identified as a front end;

q. said second levelling means comprising a movable counterweight which can move toward said front end and away from said front end to adjust the position of said longitudinal member with respect to the horizontal;

r. a power means identified as a second power means operatively connecting with said counterweight for moving said counterweight;

s. said support having an outwardly directed support arm;

t. a levelling means identified as a second levelling means for varying the position of and for levelling said two spaced apart longitudinal members with respect to the horizontal;

u. said second levelling means comprising a suspension means identified as a second suspension means for said frame;

v. said second suspension means comprising a lug identified as a first connecting means operatively connecting said frame on the right and comprising a lug identified as a second connecting means operatively connecting with said frame on the left;

w. a cable means identified as a second cable means having a first end identified as a second cable first end and having a second end identified as a second cable second end;

x. said second cable first end connecting with said first connecting means;

y. said second cable means being capable of allowing said second cable means to move with respect to said second connecting means;

z. a suspending means identified as a third suspension means positioned above said frame and being capable of receiving said second cable means and allowing said second cable means to move with respect to said third suspension means;

aa. a length adjusting means operatively connecting with said second cable second end of said second cable means to adjust the position of said longitudinal member with respect to the horizontal;

bb. an electrical energy generating means identified as a generator means on said frame;

cc. said first power means comprising an electric motor identified as a first electric motor operatively connecting with said movable plate for moving said movable plate;

dd. said second power means comprising an electric motor identified as a second electric motor operatively connecting with said counterweight for moving said counterweight;

ee. said length adjusting means comprising an electric motor identified as a third electric motor operatively connecting with said second cable second end;

ff. said first cable means, said second cable means and said third cable means operatively connecting with said generating means;

gg. a control means operatively connecting with said first cable means, said second cable means and said third cable means to control said electric motors;

hh. part of said control means may be off of and remote from said frame to allow control of said electric motors away from said frame;

ii. said third suspension means operatively connecting with said first suspension means and said second suspension means;

jj. a number of cooperating braces positioned on the upper part of said frame and defining a second supporting means;

kk. a second support;

ll. an attaching means for connecting said second support to said second supporting means;

mm. said second support having an outwardly directed support arm;

nn. two spaced apart said second supports on said second supporting means; and, oo. a back stop associated with said two spaced apart second supports to restrict the movement of an object on said frame.

17. A combination of an object and an apparatus for lifting said object, said combination comprising:

a. a frame;

b. said frame having a first supporting means;

c. a first support;

d. an attaching means for connecting said first support to said supporting means;

e. said supporting means being in a supporting relationship to said first support;

f. said object operatively connecting with said first support for said apparatus to be able to lift said object;

g. said frame comprising at least one longitudinal member and at least one lateral member;

h. a levelling means identified as a first levelling means for varying the position of and for levelling said lateral member;

i. said first levelling means comprising a suspension means identified as a first suspension means for said frame;

j. said first suspension means comprising two spaced apart guide means identified as a right guide means and a left guide means positioned laterally on said frame;

k. said first suspension means comprising a cable means identified as a first cable means associated with said guide means;

l. said first suspension means having two ends identified as a first end and a second end;

m. said first end being associated with said first cable means near said right guide means and said second end being associated with said first cable means near said left guide means;

n. a movable plate connecting with said first cable means to vary the length of said first cable means with respect to said right guide means and said first end and to vary the length of said first cable means with respect to said left guide means and said second end to adjust the lateral axis of said frame with respect to the horizontal;

o. a power means identified as a first power means operatively connecting with said movable plate for moving said movable plate;

p. a levelling means identified as a second levelling means for varying the position of and for levelling said two spaced apart longitudinal members with respect to the horizontal;

q. said second levelling means comprising a suspension means identified as a second suspension means for said frame;

r. said second suspension means comprising a lug identified as a first connecting means operatively connecting with said frame on the right and comprising a lug identified as a second connecting means operatively connecting with said frame on the left;

s. a cable means identified as a second cable means having a first end identified as a second cable first end and having a second end identified as a second cable end;

t. said second cable first end connecting with said first connecting means;

u. said second cable means being capable of allowing said second cable means to move with respect to said second connecting means;

v. a suspending means identified as a third suspension means positioned above said frame and being capable of receiving said second cable means and allowing said second cable means to move with respect to said third suspension means; and, w. a length adjusting means operatively connecting with said second cable second end of said second cable means to adjust the position of said longitudinal member with respect to the horizontal.

18. A combination of an object and an apparatus for lifting said object, said combination comprising:

a. a frame;

b. said frame having a first supporting means;

c. a first support;

d. an attaching means for connecting said first support to said supporting means;

e. said supporting means being in a supporting relationship to said first support;

f. said object operatively connecting with said first support for said apparatus to be able to lift said object;

g. said frame comprising at least one longitudinal member and at least one lateral member;

h. a levelling means identified as a first levelling means for varying the position of and for levelling said member;

i. said first levelling meahs comprising a suspension means identified as a first suspension means for said frame;

j. said first suspension means comprising two spaced apart guide means identified as a right guide means and a left guide means positioned laterally on said frame;

k. said first suspension means comprising a cable means identified as a first cable means associated with said guide means;

l. said first suspension means having two ends identified as a first end and a second end;

m. said first end being associated with said first cable means near said right guide means and said second end being associated with said first cable means near said left guide means;

n. a movable plate connecting with said first cable means to vary the length of said first cable means with respect to said right guide means and said first end and to vary the length of said first cable means with respect to said left guide means and said second end to adjust the lateral axis of said frame with respect to the horizontal;

o. a power means identified as a first power means operatively connecting with said movable plate for moving said movable plate;

p. a levelling means identified as a second levelling means for varying the position of and for levelling said two spaced apart longitudinal members with respect to the horizontal;

q. said frame having an end identified as a front end;

r. said second levelling means comprising a movable counterweight which can move toward said front end and away from said front end to adjust the position of said longitudinal member with respect to the horizontal;

s. a power means identified as a second power means operatively connecting with said counterweight for moving said counterweight;

t. said support having an outwardly directed support arm;

u. a levelling means identified as a second levelling means for varying the position of and for levelling said two spaced apart longitudinal members with respect to the horizontal;

v. said second levelling means comprising a suspension means identified as a second suspension means for said frame;

w. said second suspension means comprising a lug identified as a first connecting means operatively connecting with said frame on the right and comprising a lug identified as a second connecting means operatively connecting with said frame on the left;

x. a cable means identified as a second cable means having a first end identified as a second cable first end and having a second end identified as a second cable end;

y. said second cable first end connecting with said first connecting means;

z. said second cable means being capable of allowing said second cable means to move with respect to said second connecting means;

aa. a suspending means identified as a third suspension means positioned above said frame and being capable of receiving said second cable means and allowing said second cable means to move with respect to said third suspension means;

bb. a length adjusting means operatively connecting with said second cable end of said second cable means to adjust the position of said longitudinal member with respect to the horizontal;

cc. an electrical energy generating means identified as a generator means on said frame;

dd. said first power means comprising an electric motor identified as a first electric motor operatively connecting with said movable plate for moving said movable plate;

ee. said second power means comprising an electric motor identified as a second electric motor operatively connecting with said counterweight for moving said counterweight;

ff. said length adjusting means comprising an electric motor identified as a third electric motor operatively connecting with said second cable second end;

gg. said first cable means, said second cable means and said third cable means operatively connecting with said generating means;

hh. a control means operatively connecting with said first cable means, said second cable means and said third cable means to control said electric motor;

ii. part of said control means may be off of and remote from said frame to allow control of said electric motors away from said frame; and, jj. said third suspension means operatively connecting with said first suspension means and said second suspension means.

19. A combination of an object and an apparatus for lifting said object, said combination comprising:

a. a frame;

b. said frame having a first supporting means;

c. a first support;

d. an attaching means for connecting said first support to said supporting means;

e. said supporting means being in a supporting relationship to said first support;

f. said object operatively connecting with said first support for said apparatus to be able to lift said object;

g. said frame comprising at least one longitudinal member and at least one lateral member;

h. a levelling means identified as a first levelling means for varying the position of and for levelling said member;

i. said first levelling means comprising a suspension means identified as a first suspension means for said frame;

j. said first suspension means comprising two spaced apart guide means identified as a right guide means and a left guide means positioned laterally on said frame;

k. said first suspension means comprising a cable means identified as a first cable means associated with said guide means;

l. said first suspension means having two ends identified as a first end and a second end;

m. said first end being associated with said first cable means near said right guide means and said second end being associated with said first cable means near said left guide means;

n. a movable plate connecting with said first cable means to vary the length of said first cable means with respect to said right guide means and said first end and to vary the length of said first cable means with respect to said left guide means and said second end to adjust the lateral axis of said frame with respect to the horizontal;

o. a power means identified as a first power means operatively connecting with said movable plate for moving said movable plate;

p. a levelling means identified as a second levelling means for varying the position of and for levelling said two spaced apart longitudinal members with respect to the horizontal;

q. said frame having an end identified as a front end;

r. said second levelling means comprising a movable counterweight which can move toward said front end and away from said front end to adjust the position of said longitudinal member with respect to the horizontal;

s. a power means identified as a second power means operatively connecting with said counterweight for moving said counterweight;

u. a levelling means identified as a second levelling means for varying the position of and for levelling said two spaced apart longitudinal members with respect to the horizontal;

v. said second levelling means comprising a suspension means identified as a second suspension means for said frame;

w. said second suspension means comprising a lug identified as a first connecting means operatively connecting with said frame on the right and comprising a lug identified as a second connecting means operatively connecting with said frame on the left;

x. a cable means identified as a second cable means having a first end identified as a second cable first end and having a second end identified as a second cable end;

y. said second cable first end connecting with said first connecting means;

z. said second cable means being capable of allowing said second cable means to move with respect to said second connecting means;

aa. a suspending means identified as a third suspension means positioned above said frame and being capable of receiving said second cable means and allowing said second cable means to move with respect to said third suspension means;

bb. a length adjusting means operatively connecting with said second cable second end of said second cable means to adjust the position of said longitudinal member with respect to the horizontal;

cc. an electrical energy generating means identified as a generator means on said frame;

dd. said first power means comprising an electric motor identified as a first electric motor operatively connecting with said movable plate for moving said movable plate;

ee. said second power means comprising an electric motor identified as a second electric motor operatively connecting with said counterweight for moving said counterweight;

ff. said length adjusting means comprising an electric motor identified as a third electric motor operatively connecting with said second cable second end;

gg. said first cable means, said second cable means and said third cable means operatively connecting with said generating means;

hh. a control means operatively connecting with said first cable means, said second cable means and said third cable means to control said electric motor;

ii. part of said control means may be off of and remote from said frame to allow control of said electric motors away from said frame;

jj. said third suspension means operatively connecting with said first suspension means and said second suspension means;

kk. two spaced apart said first supports on said first supporting means; and, ll. a back stop associated with said two spaced apart first supports to restrict the movement of an object on said outwardly directed support arms with respect to said frame.

20. A combination of an object and an apparatus for lifting said object, said combination comprising:

a. a frame;

b. said frame having a first supporting means;

c. a first support;

d. an attaching means for connecting said first support to said supporting means;

e. said supporting means being in a supporting relationship to said first support;

f. said object operatively connecting with said first support for said apparatus to be able to lift said object;

g. said frame comprising at least one longitudinal member and at least one lateral member;

h. a levelling means identified as a first levelling means for varying the position of and for levelling said member;

i. said first levelling means comprising a suspension means identified as a first suspension means for said frame;

j. said first suspension means comprising two spaced apart guide means identified as a right guide means and a left guide means positioned laterally on said frame;

k. said first suspension means comprising a cable means identified as a first cable means associated with said guide means;

l. said first suspension means having two ends identified as a first end and a second end;

m. said first end being associated with said first cable means near said right guide means and said second end being associated with said first cable means near said left guide means;

n. a movable plate connecting with said first cable means to vary the length of said first cable means with respect to said right guide means and said first end and to vary the length of said first cable means with respect to said left guide means and said second end to adjust the lateral axis of said frame with respect to the horizontal;

o. a power means identified as a first power means operatively connecting with said movable plate for moving said movable plate;

p. a levelling means identified as a second levelling means for varying the position of and for levelling said two spaced apart longitudinal members with respect to the horizontal;

q. said frame having an end identified as a front end;

r. said second levelling means comprising a movable counterweight which can move toward said front end and away from said front end to adjust the position of said longitudinal member with respect to the horizontal;

s. a means identified as a second power means operatively connecting with said counterweight for moving said counterweight;

t. said support having an outwardly directed support arm;

u. a levelling means identified as a second levelling means for varying the position of and for levelling said two spaced apart longitudinal members with respect to the horizontal;

v. said second levelling means comprising a suspension means identified as a second suspension means for said frame;

w. said second suspension means comprising a lug identified as a first connecting means operatively connecting said frame on the right and comprising a lug identified as a second connecting means operatively connecting with said frame on the left;

x. a cable means identified as a second cable means having a first end identified as a second cable first end and having a second end identified as a second cable end;

y. said second cable first end connecting with said first connecting means;

z. said second cable means being capable of allowing said second cable means to move with respect to said second connecting means;

aa. a suspending means identified as a third suspension means positioned above said frame and being capable of receiving said second cable means and allowing said second cable means to move with respect to said third suspension means;

bb. a length adjusting means operatively connecting with said second cable second end of said second cable means to adjust the position of said longitudinal member with respect to the horizontal;

cc. an electrical energy generating means identified as a generator means on said frame;

dd. said first power means comprising an electric motor identified as a first electric motor operatively connecting with said movable plate for moving said movable plate;

ee. said second power means comprising an electric motor identified as a second electric motor operatively connecting with said counterweight for moving said counterweight;

ff. said length adjusting means comprising an electric motor identified as a third electric motor operatively connecting with said second cable second end;.

gg. said first cable means, said second cable means and said third cable means operatively connecting with said generating means;

hh. a control means operatively connecting with said first cable means, said second cable means and said third cable means to control said electric motor;

ii. part of said control means may be off of and remote from said frame to allow control of said electric motor away from said frame;

jj. said third suspension means operatively connecting with said first suspension means and said second suspension means;

kk. a number of cooperating braces positioned on the upper part of said frame and defining a shaped supporting means;

ll. a second support;

mm. an attaching means for connecting said second support to said second supporting means;

nn. said second support having an outwardly directed support arm;

oo. Two spaced apart said second supports on said second supporting means; and, pp. a back stop associated with said two spaced apart second supports to restrict the movement of an object on said outerwardly directed support arms with respect to said frame.

* * * * *